US008994714B2

(12) United States Patent
Erinjippurath et al.

(10) Patent No.: US 8,994,714 B2
(45) Date of Patent: Mar. 31, 2015

(54) METHOD AND SYSTEM FOR DISPLAY CALIBRATION WITH FEEDBACK DETERMINED BY A CAMERA DEVICE

(75) Inventors: Gopal Erinjippurath, San Francisco, CA (US); Glenn N. Dickins, Como (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 1121 days.

(21) Appl. No.: 12/888,873

(22) Filed: Sep. 23, 2010

(65) Prior Publication Data

US 2012/0074851 A1 Mar. 29, 2012

(51) Int. Cl.
*G09G 5/00* (2006.01)
*G09G 3/20* (2006.01)

(52) U.S. Cl.
CPC ..... *G09G 3/20* (2013.01); *G09G 2320/0693* (2013.01)
USPC ..... 345/214; 345/589; 248/51; 248/177; 248/180

(58) Field of Classification Search
USPC ..... 345/214, 589, 591, 593; 348/51, 348/177–180, 189, 744–745
See application file for complete search history.

(56) References Cited

U.S. PATENT DOCUMENTS 6,771,307 B2 * 8/2004 Waki et al. ..... 348/189
7,133,148 B2 * 11/2006 Silverstein ..... 358/1.15
7,167,197 B2 1/2007 Hill et al.

(Continued)

FOREIGN PATENT DOCUMENTS

EP 1079605 2/2001
EP 1116385 2/2004
KR 2003-0080140 10/2003

OTHER PUBLICATIONS

Tansley et al., "Image photometry applied to measuring visual displays", Flat Panel Display Technology and Display Metrology II, Edward F. Kelley, Tolis Voutsas, Editors, 188 Proceedings of SPIE vol. 4295 (2001) © 2001.

(Continued)

*Primary Examiner* — Jason M Crawford

(57) ABSTRACT

In a class of embodiments, a method and system for calibrating a display using feedback indicative of measurements of light, emitted from the display (typically during display of a test pattern), by a camera device whose camera has a sensitivity function that is unknown a priori but which is operable to measure light emitted by a display in a manner emulating at least one measurement by a reference camera having a known sensitivity function. Typically, the camera device is a handheld camera device including an inexpensive, uncalibrated camera. In another class of embodiments, a system including a display (to be recalibrated), a video preprocessor coupled to the display, and a feedback subsystem including a camera device operable to measure light emitted by the display. The feedback subsystem is coupled and configured to generate preprocessor control parameters in response to measurement data (indicative of measurements by the camera device) and to assert the preprocessor control parameters as calibration feedback to the preprocessor. The preprocessor is operable to calibrate (e.g., recalibrate) the display in response to the control parameters by filtering input image data (e.g., input video data) to be displayed, for example to automatically and dynamically correct for variations in calibration of the display.

56 Claims, 10 Drawing Sheets

(56) References Cited

U.S. PATENT DOCUMENTS

| | | | | |
|---|---|---|---|---|
| 7,187,343 | B2 * | 3/2007 | Pate | 345/1.2 |
| 7,262,779 | B1 * | 8/2007 | Sones | 345/589 |
| 7,639,260 | B2 * | 12/2009 | Bala et al. | 345/581 |
| 7,639,401 | B2 | 12/2009 | Bala et al. | |
| 7,728,845 | B2 | 6/2010 | Holub | |
| 7,733,404 | B2 * | 6/2010 | Zandifar et al. | 348/333.01 |
| 8,736,674 | B2 * | 5/2014 | Hovanky et al. | 348/51 |
| 2004/0196250 | A1 | 10/2004 | Mehrotra et al. | |
| 2006/0126134 | A1 * | 6/2006 | Bala et al. | 358/504 |
| 2006/0280360 | A1 * | 12/2006 | Holub | 382/162 |
| 2007/0171380 | A1 * | 7/2007 | Wright et al. | 353/69 |
| 2007/0279390 | A1 * | 12/2007 | Loukianov | 345/169 |
| 2008/0062164 | A1 * | 3/2008 | Bassi et al. | 345/214 |
| 2008/0088649 | A1 | 4/2008 | Ikeno | |
| 2008/0218501 | A1 | 9/2008 | Diamond | |
| 2008/0259289 | A1 | 10/2008 | Nozaki et al. | |
| 2009/0066857 | A1 * | 3/2009 | Camp, Jr. | 348/744 |
| 2010/0079703 | A1 | 4/2010 | Chung | |
| 2010/0208044 | A1 | 8/2010 | Robinson | |
| 2011/0279749 | A1 | 11/2011 | Erinjippurath | |
| 2012/0062607 | A1 | 3/2012 | Erinjippurath | |
| 2012/0127324 | A1 | 5/2012 | Dickins | |

OTHER PUBLICATIONS

Dallas et al., "Image quality analysis of a color LCD as well as a monochrome LCD using a Foveon color CMOS camera", Penetrating Radiation Systems and Applications VIII; Proc. of SPIE vol. 6707, 67070U, (Aug. 2007), edited by F. Patrick Doty, et al.; Department of Radiology, University of Arizona, Tucson AZ, 85724; pp. 67070U 1-10.

Tyler, et al., "Real-Time Projector Tracking on Complex Geometry Using Ordinary Imagery", Computer Vision and Pattern Recognition, 2007.CVPR '07, published on Jun. 17-22, 2007; pp. 1-8.

Brown, et al., "Camera-Based Calibration Techniques for Seamless Multiprojector Displays", Transactions on Visualization and Computer Graphics, vol. 11, No. 2, published on Mar./Apr. 2005; pp. 193-206.

Reinhard, et al., "Photographic Tone Reproduction for Digital Images".

"UIImagePickerControllerDelegate Protocol Reference", Apple, Inc., Aug. 19, 2010; pp. 3-12.

Connolly, et al., "Colour measurement by video camera", JSDC vol. 111, published Dec. 1995, pp. 373-375.

Connolly, et al., "The Use of Video Cameras for Remote Colour Measurement", JSDC vol. 112, published Feb. 1996, pp. 40-43.

* cited by examiner

METHOD AND SYSTEM FOR DISPLAY CALIBRATION WITH FEEDBACK DETERMINED BY A CAMERA DEVICE

BACKGROUND OF THE INVENTION

1. Field of the Invention

Some embodiments of the invention are systems and methods for calibrating a display using a camera device (e.g., a handheld camera device) to measure light emitted by the display in a manner emulating measurements by a reference camera having known sensitivity function but without preknowledge of the sensitivity function of the camera device's camera. In typical embodiments, preprocessor control parameters determined using a handheld or camera device are asserted as feedback to a video preprocessor to recalibrate a display.

2. Background of the Invention

Throughout this disclosure including in the claims, the expression performing an operation "on" signals or data (e.g., filtering or scaling the signals or data) is used in a broad sense to denote performing the operation directly on the signals or data, or on processed versions of the signals or data (e.g., on versions of the signals that have undergone preliminary filtering prior to performance of the operation thereon).

Throughout this disclosure including in the claims, the expression "system" is used in a broad sense to denote a device, system, or subsystem. For example, a subsystem that implements a filter may be referred to as a filter system, and a system including such a subsystem (e.g., a system that generates X output signals in response to multiple inputs, in which the subsystem generates M of the inputs and the other X-M inputs are received from an external source) may also be referred to as a filter system.

Throughout this disclosure including in the claims, the noun "display" and the expression "display device" are used as synonyms to denote any device or system operable to display an image or to display video in response to an input signal. Examples of displays are computer monitors, television sets, and home entertainment system monitors or projectors.

Throughout this disclosure including in the claims, the terms "calibration" and "recalibration" of a display denote adjusting at least one parameter or characteristic of the display, e.g., a color, brightness, contrast, and/or dynamic range characteristic of the display. For example, recalibration of a display device can be implemented by performing preprocessing on input image data (to be displayed by the display device) to cause the light emitted by the display device in response to the preprocessed image data (typically after further processing is performed thereon) to have one or more predetermined color, brightness, contrast, and/or dynamic range characteristics.

Throughout this disclosure including in the claims, the term "processor" is used in a broad sense to denote a system or device programmable or otherwise configurable (e.g., with software or firmware) to perform operations on data (e.g., video or other image data). Examples of processors include a field-programmable gate array (or other configurable integrated circuit or chip set), a digital signal processor programmed and/or otherwise configured to perform pipelined processing on video or other image data, a programmable general purpose processor or computer, and a programmable microprocessor chip or chip set.

Throughout this disclosure including in the claims, measured "light intensity" is used in a broad sense, and can denote measured luminance or another measured indication of light intensity appropriate in the context in which the expression is used.

Throughout this disclosure including in the claims, the term "camera" is used in a broad sense to denote a light sensor (e.g., a colorimeter or other sensor whose output can be analyzed to determine a color or frequency spectrum of sensed light), or a camera including an image sensor array (e.g., a CCD camera), or a camera of any other type. Typical embodiments of the invention employ a handheld camera device which includes a camera operable to sense an image displayed by a monitor or other display and to output data indicative of the sensed image (or one or more pixels thereof).

Throughout this disclosure including in the claims, the expression "camera device" denotes a device which includes (e.g., is) a camera and a processor coupled to receive the camera's output, and which is operable to measure at least one characteristic of light emitted by a display device (e.g., while the display device displays at least one test image) in a manner emulating measurement of the same light by a reference camera having known sensitivity function but without preknowledge of the sensitivity function of the camera device's camera. For example, a mobile phone which includes a camera and a processor coupled to receive the camera's output may be a camera device as defined in this paragraph. Typical embodiments of the invention include or employ a camera device which is a handheld device ("HHD") or other portable device. Other embodiments of the invention include or employ a camera device which is not readily portable. In typical embodiments of the invention, a camera device (e.g., implemented as an HHD) is operable to download data indicative of a prior characterization or calibration of a display (e.g., data indicative of a sensitivity function of a reference camera employed to perform the prior characterization or calibration) and to measure at least one characteristic of light emitted by the display using the camera device's camera and the downloaded data in connection with a recalibration of the display. In a display characterizing operation (preliminary to color calibration of a display using a camera device in some embodiments of the invention), a reference camera having a known sensitivity function is used to measure the display's output as a function of wavelength in response to test colors and a white point. A set of reference values (e.g., values of a transfer function that matches the display's response for each test color and white point to the reference camera's response, and values of the reference camera's sensitivity function) are stored and later provided to the camera device, so that the camera device's output in response to light emitted by the display (e.g., during display of at least one test image) can be used with the reference values to emulate measurement of the same light by the reference camera.

It is conventional for a user to manually adjust controls of a display device to adjust or calibrate the device while the device displays test patterns (e.g., in response to test pattern data read from a DVD or other disk). While a display device displays test patterns, it is also conventional to use a colorimeter or camera to generate data that characterize the display device and/or data indicative of recommended settings for adjusting or calibrating the display device (e.g., to match target settings). With knowledge of such data, a user can manually adjust (or enter commands which cause adjustment of) controls of the display device to obtain a visually pleasing and/or acceptable displayed image appearance or to match target settings. It is also conventional to use such data to generate control values, and to assert the control values to a graphics card of the display device to calibrate the display device. For example, it is known to use a computer programmed with appropriate software to generate control values which determine look-up tables (LUTs) in response to such data and to assert the control values to the graphics card (e.g., to match target settings previously provided to the computer).

In professional reference environments (e.g., studios and post production facilities), such conventional techniques can be used to calibrate a display for use as a reference to grade content and adjust color, brightness, contrast, and/or tint parameters of content. An off-calibrated display can lead to dire consequences in the production environment and repair and/or recalibration can be very expensive. In such environments, there is a need for a closed-loop, carefully characterized measurement system that can automatically correct for variations in display calibration.

There is also a need for a closed-loop, carefully characterized measurement system that can automatically correct for variations in calibration of displays in a variety of environments (e.g., home entertainment system displays, and displays of home or business computer systems) without the need for the user to employ a highly calibrated imaging colorimeter (such colorimeters are typically expensive and difficult to set up) or other expensive, calibrated light or image sensor(s). Displays often need to be recalibrated in the field (e.g., in consumers' homes) with minimal field support, and often need to adapt to different external lighting environments. It had not been known before the present invention how to implement such a system with a camera device whose camera has a sensitivity function that is unknown "a priori" (e.g., an inexpensive handheld camera device including an inexpensive, uncalibrated camera) but which is operable to measure light emitted by a display in a manner emulating measurements by a reference camera having a known sensitivity function (e.g., an expensive, highly calibrated imaging colorimeter).

There is also a need for a closed-loop, carefully characterized measurement and calibration system that can automatically and dynamically correct for variations in calibration of a display, where the display is not configured to be calibrated (e.g., recalibrated) automatically in response to control signals generated automatically (without human user intervention) in response to camera measurements of light emitted by the display. For example, such a display may be configured to be recalibrated only in response to a human user's manual adjustment of color, brightness, contrast, and/or tint controls, or it may be the display device of a computer system that can be adjusted or recalibrated only in response to commands entered by human user by manually actuating an input device of the system (e.g., by entering mouse clicks while viewing a displayed user interface). Displays of this type often need to be recalibrated in the field with minimal field support, and should dynamically adapt to different external lighting environments. However, it had not been known before the present invention how to implement a closed-loop, carefully characterized measurement system to automatically correct for variations in calibration of a display of this type (including variations resulting from changes in external lighting environment).

BRIEF DESCRIPTION OF THE INVENTION

In a class of embodiments, the invention is a method and system for calibrating a display using feedback indicative of measurements, by a camera of a camera device, of light emitted from the display, said camera having a sensitivity function that is unknown a priori. The camera's sensitivity function is unknown "a priori" in the sense that although it may be determined during performance of the inventive method from measurements by the camera and reference values that do not themselves determine the camera's sensitivity function, it need not be (and typically is not) known before performance of the inventive method. To characterize the display, the camera senses light emitted from the display (typically during display of at least one test pattern) and in response to the camera output, the camera device generates measurement data indicative of the light emitted, such that the measurement data emulate measurement of the light by a reference camera having known sensitivity function (e.g., a highly calibrated imaging colorimeter or other calibrated reference camera) in the sense that the measurement data are indicative of at least one measurement of said light by the reference camera. Typically, the camera device is a handheld camera device whose camera is an inexpensive, uncalibrated camera. In typical embodiments, the camera device includes a processor coupled and configured (e.g., programmed with software) to generate the measurement data (i.e., to receive raw output from the camera and process the raw output to generate the measurement data) and send the measurement data as feedback to a remote server.

In a second class of embodiments, the inventive system includes a display (to be recalibrated), a video preprocessor coupled to the display, and a feedback subsystem including a handheld device (e.g., a handheld camera device) operable to measure light emitted by the display. The feedback subsystem is coupled and configured to generate preprocessor control parameters automatically in response to measurement data (indicative of measurements by the handheld device) and to assert the preprocessor control parameters as calibration feedback to the video preprocessor. The video preprocessor is operable to calibrate (e.g., recalibrate) the display in response to the control parameters, by filtering input image data (e.g., input video data) to be displayed (e.g., to automatically and dynamically correct for variations in calibration of the display). The preprocessor control parameters are generated automatically, by the handheld device alone or (preferably) by the handheld device in combination with a remote display management server (or other remote device) of the feedback subsystem. In the second class of embodiments, the inventive system has a feedback control loop architecture. In some preferred embodiments in the second class, the feedback subsystem includes a remote server, the handheld device includes a processor coupled and configured (e.g., programmed with software) to generate the measurement data and send said measurement data to the remote server (e.g., over the internet or another network), and the remote server is configured to generate the preprocessor control parameters automatically in response to the measurement data. In some embodiments in the second class, the handheld device includes a processor coupled and configured (e.g., programmed with software) to generate the measurement data, to generate the preprocessor control parameters in response to said measurement data, and to send the preprocessor control parameters to the video preprocessor (e.g., over the internet or another network).

In typical embodiments in the second class, the handheld device is a camera device including a camera whose sensitivity function is unknown (a priori) but which is operable to measure light emitted by the display in a manner emulating at least one measurement by a reference camera having a known sensitivity function (e.g., an expensive, highly calibrated imaging colorimeter), and the measurement data are indicative of the camera's output in response to light emitted by the display. In some embodiments in the second class, the handheld device is a handheld device includes a camera and a processor coupled and configured to receive raw output from the camera and to perform at least some processing on the raw output to generate the measurement data.

Video preprocessors are often used conventionally for noise reduction, color correction, and/or other processing of input video data (or image data) to be displayed by display systems coupled thereto. In typical embodiments in the second class, the video preprocessor is a device separate from the display, and is coupled (e.g., by a cable) to an input of the display. Alternatively, the video preprocessor (and optionally a video processor coupled thereto) are integrated with the display.

Preferably, the video preprocessor is operable to perform all of color, contrast, and dynamic range calibration of the display in response to the preprocessor control parameters.

In accordance with typical embodiments of the invention, a set of test images (sometimes denoted herein as test patterns) is provided for display by the display device to be calibrated, and a camera (or handheld) device measures light emitted in response to the test images. For example, to allow color calibration the display device can display test images indicative of primary colors (e.g., primaries of a standard color space) and at least one white point (e.g., a standard white point). Preferably, all three of color, contrast, and dynamic range calibration of the display device are performed.

To perform contrast calibration in accordance with some embodiments, a camera (or handheld) device senses the image displayed by the display device in response to a checkerboard test pattern that is non-uniform (in the sense that the size of its individual fields varies with spatial position in the displayed image), to determine local (intra-frame) contrast as a function of spatial position in the displayed image. In some embodiments, a processor of the camera (or handheld) device recognizes location within the displayed image by recognizing a feature size associated with each location, and determines contrast at each of one or more locations. The resolution (feature size) at which the fields of uniform checkerboard pattern become flat (i.e., the minimum resolvable displayed feature size of the test pattern's features) can readily and efficiently be determined.

A camera's dynamic range is the ratio of the maximum and minimum light intensities measurable by the camera. A display's dynamic range is the ratio of the maximum and minimum light intensities that can be emitted by the display. To perform brightness or dynamic range calibration of a display in accordance with some embodiments of the invention, the dynamic range relationship between a camera (of camera or handheld device) and the display is determined as follows. The minimum light intensity measurable by the camera is typically determined by the camera noise at the exposure values employed. Camera noise can be estimated by taking a few camera images of a black surface. The maximum light intensity measurable by the camera (the high end of the camera's dynamic range) is determined by the measured intensity at which the sensors in the camera start to saturate. To measure the intensity at which the sensors in a camera start to saturate, the camera can be operated to image a displayed black and white test pattern having a range of emitted brightness values at different spatial locations. Preferably, the test pattern is such that the emitted brightness increases with increasing distance from a specific spatial location of the displayed image. For example, the test pattern can be checkerboard pattern or VESA box (comprising a pattern of white and black features) whose ratio of total white feature area to total black feature area in a local region increases (continuously or stepwise) with increasing distance from a specific spatial location on the test pattern. By displaying such a test pattern with brightness so as not to saturate any sensor in the camera that receives light emitted from any spatial location of the displayed image, the display's dynamic range can be estimated by extrapolating the steps in the camera response given knowledge of the displayed brightness as a function of spatial location of the displayed pattern.

In a display characterizing operation (preliminary to color calibration of a display in accordance with some embodiments of the invention), a reference camera which is precalibrated in the sense that it has a known sensitivity function, $f_c(\lambda)$, where "$\lambda$" denote wavelength, is used to measure the output of the display, $f_D(\lambda)$, as a function of wavelength in response to each test color and white point determined by a set of test patterns. This determines $f_T(\lambda)=f_D(\lambda)/f_c(\lambda)$, which is the transfer function that matches the display response (for each test color and white point) to the reference camera response. For each test color and white point, a set of values $f_T(\lambda)=f_D(\lambda)/f_c(\lambda)$, and a set of the reference camera sensitivity values $f_c(\lambda)$, for each wavelength, $\lambda$, of a set of wavelengths, are stored for later provision (e.g., downloading over the internet or another network) to a camera device. Optionally, values of the display's output $f_D(\lambda)$ at each wavelength in the set are stored for later provision (e.g., downloading over the internet or another network) to a camera device.

Then (at some "initial" time), a camera device having a camera whose camera spectral sensitivity function, $f'_c(\lambda)$ can be (and typically is) unknown, is used to measure the output, $f'_D(\lambda)$, of the same display device in response to the same test colors and white point (e.g., in response to the same displayed test patterns) for each wavelength, $\lambda$, of the set of wavelengths. The previously determined values $f_T(\lambda)=f_D(\lambda)/f_c(\lambda)$, and $f_c(\lambda)$, for each of the wavelengths are provided (e.g., downloaded over the internet) to the camera device. The camera device is programmed to determine values $f'_c(\lambda)=(f'_D(\lambda)/f_D(\lambda))*(f_c(\lambda))=f'_D(\lambda)/(f_D(\lambda)/f_c(\lambda))$, which are considered to determine the camera sensitivity function of its camera, from the measured $f'_D(\lambda)$ values and the provided $f_D(\lambda)/f_c(\lambda)$ values.

In order to recalibrate the display device to match its settings as determined in the preliminary display characterizing operation, the previously determined display output values $f_D(\lambda)$ are provided (e.g., downloaded over the internet) to the camera device. Using the measured $f'_D(\lambda)$ values, the provided $f_c(\lambda)$ and $f_D(\lambda)$ values, and the determined $f'_c(\lambda)$ values, the camera device determines $f''_D(\lambda)=(f_c(\lambda)/f'_c(\lambda))*(f'_D(\lambda)$, for each of the wavelengths, which is the display response function (at the initial) that would have been measured using the calibrated reference camera rather than the camera device's camera. The $f''_D(\lambda)$ values are used (e.g., sent to a remote server) to recalibrate the display. In some embodiments, the camera device determines difference values $d_D(\lambda)=f''_D(\lambda)-f_D(\lambda)$, using the determined $f''_D(\lambda)$ values and the provided $f'_D(\lambda)$ values, for each of the wavelengths. The values $d_D(\lambda)$ are indicative of the difference between the display response function at the initial time and at the time of the preliminary characterizing operation. The difference values $d_D(\lambda)$ values may be used (e.g., sent to a remote server) to efficiently recalibrate the display to match its settings at the time of the preliminary characterizing operation.

Alternatively, the determined $f'_c(\lambda)$ values (and typically also the $f'_D(\lambda)$ values) are stored in the camera device. Then, some time (T1) after the initial time, in order to recalibrate the display device (e.g., to match its settings at the initial time), the camera device is again used to measure the output of the display device, $f''_D(\lambda)$, in response to each test color and white point. Using the measured $f''_D(\lambda)$ values and the stored $f_c(\lambda)$ and $f'_c(\lambda)$ values, the camera device determines $f'''_D(\lambda)=(f_c$ $(\lambda)/f'_c(\lambda))*(f''_D(\lambda)$, for each of the wavelengths, which is the display response function (at the time T1) that would have been measured using the calibrated reference camera rather than the camera device's camera. The $f'''_D(\lambda)$ values are used (e.g., sent to a remote server) to recalibrate the display.

In some embodiments, the camera device determines difference values $d_D(\lambda)=(f_c(\lambda)/f'_c(\lambda))*(f''_D(\lambda)-f'_D(\lambda))$, using the measured $f''_D(\lambda)$ values and the stored $f_c(\lambda)$, $f'_c(\lambda)$, and $f'_D(\lambda)$ values, for each of the wavelengths. The function $d_D(\lambda)$ is the difference between the display response function at the time T1 and the display response function at the initial time, that would have been measured using the calibrated reference camera rather than the camera device's camera. The difference values $d_D(\lambda)$ values may be used (e.g., sent to a remote server) to efficiently recalibrate the display to match its settings at the initial time.

For a particular camera device (for example, a handheld camera device), it is contemplated that reference data indicative of color matching and/or color response functions (e.g., the above-mentioned reference camera sensitivity function $f_c(\lambda)$, and display response $f_D(\lambda)$) for a particular display can be packaged (e.g., by the manufacturer) into a file readable by the camera device. In order to recalibrate the color or contrast of a display, a user could load the reference data and appropriate application software into a camera device. While executing the software, the camera device would make necessary measurements of light emitted by the display, and compare them against corresponding values of the reference data for the measured display, and preferably also determine difference values indicative of the differences between the measured values and corresponding reference data values. For example, at a time T1, using reference data indicative of a reference camera sensitivity function $f_c(\lambda)$, and display response $f_D(\lambda)$ previously generated using the reference camera, the camera device could determine values $f'_c(\lambda)=f'_D(\lambda)/(f_D(\lambda)/f_c(\lambda))$ indicative of the sensitivity function of the camera device's camera, and values indicative of display response function $f'''_D(\lambda)=(f_c(\lambda)/f'_c(\lambda))*(f''_D(\lambda))$, which is the display response function at the time T1 that would have been measured using the reference camera used to generate the previously determined display response $f_D(\lambda)$, where $f''_D(\lambda)$ is the display response function at the time T1 measured using the camera device's camera). The camera device could then compute difference values $\Delta_D(\lambda)=(f'''_D(\lambda)-f_D(\lambda))$, for each of a set of measured wavelengths. The difference values (indicative of changes in characteristics of the display since its original calibration using the reference camera) would then be used to recalibrate the display (e.g., the difference values are sent to a remote server which generates preprocessor control parameters in response thereto, and sends the preprocessor control parameters to a video preprocessor which uses them to recalibrate the display). More generally, the difference values can be used for one or more of the following operations: auto-recalibration of a display; and feedback preprocessing of input image data (to be displayed by a display) for accurate display management.

An aspect of the invention is a handheld camera device configured (e.g., programmed) to generate measurement data in accordance with any embodiment of the inventive method. Other aspects of the invention include a system or device configured (e.g., programmed) to perform any embodiment of the inventive method, a display calibration (e.g., recalibration) method performed by any embodiment of the inventive system, and a computer readable medium (e.g., a disc) which stores code for implementing any embodiment of the inventive method of steps thereof. For example, the inventive camera device can include (and the inventive remote server can be or include) a programmable general purpose processor or microprocessor, programmed with software or firmware and/or otherwise configured to perform any of a variety of operations on data, including an embodiment of the inventive method or steps thereof. Such a general purpose processor may be or include a computer system including an input device, a memory, and a graphics card that is programmed (and/or otherwise configured) to perform an embodiment of the inventive method (or steps thereof) in response to data asserted thereto.

DETAILED DESCRIPTION OF THE PREFERRED EMBODIMENTS

Many embodiments of the present invention are technologically possible. It will be apparent to those of ordinary skill in the art from the present disclosure how to implement them. Embodiments of the inventive system and method will be described with reference to FIGS. 1-3.

Figure 1:
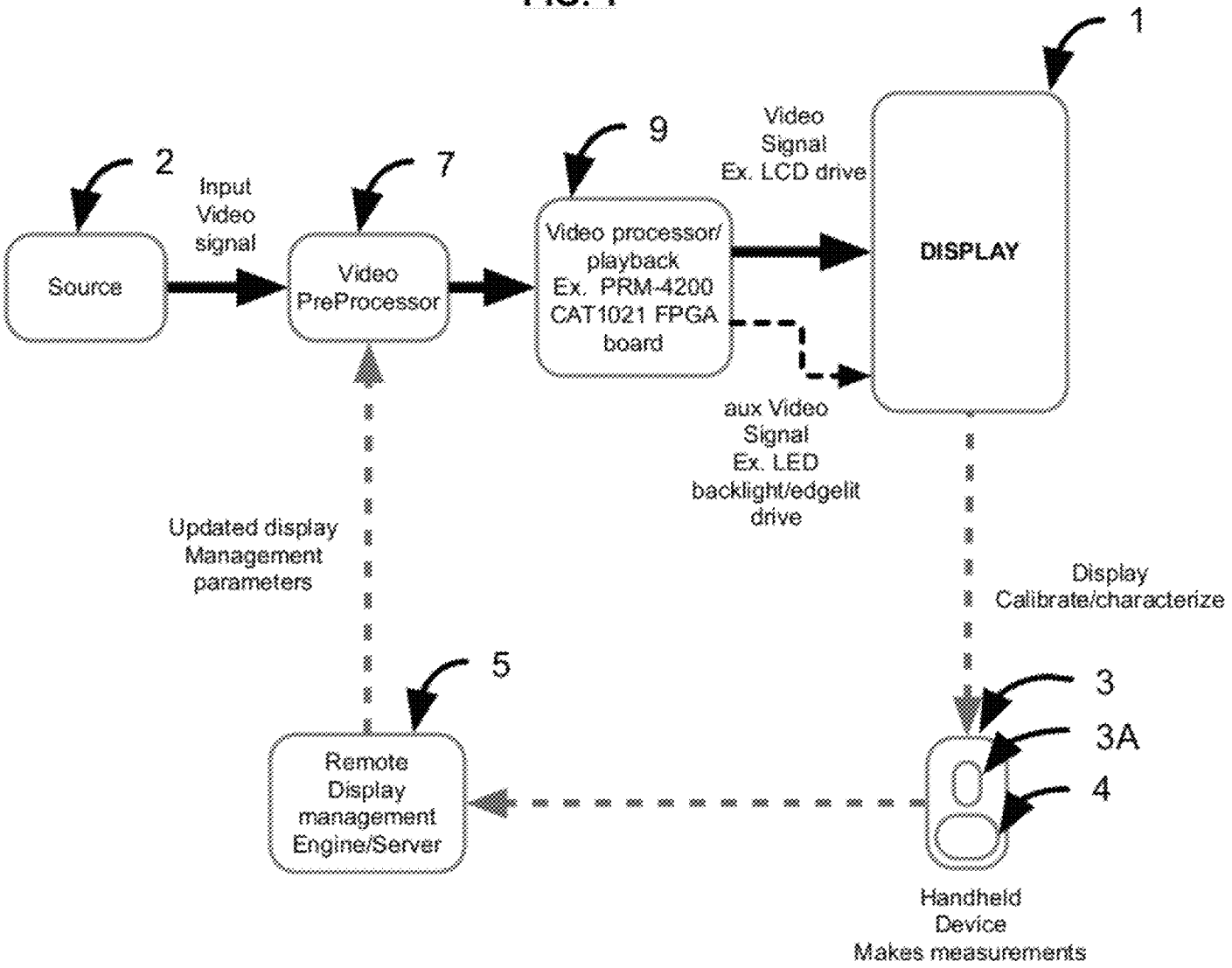
FIG. 1 is a block diagram of an embodiment of the inventive system.

FIG. 1 is a block diagram of an embodiment of the inventive system. The system of FIG. 1 includes display device 1 configured to display images sequentially in response to a video input signal from source 2. Display device 1 may be implemented as any of a variety of display devices, (e.g., a standard LCD display, a high contrast LCD display, or another display device). For example, in a class of implementations, device 1 is an LED or LCD display including a front panel (comprising an array of LCD or LED pixels) and a backlighting (or edge-lighting) system for illuminating the pixels of the front panel. A backlighting system typically includes a backlight panel comprising an array of individually controllable LEDs. An edge-lighting system typically includes individually controllable LEDs arranged along edges of a front panel, and a subsystem which directs light from these LEDS to the pixels of the front panel.

Video processor 9 is coupled to assert a video signal to display device 1 for driving the pixels of display device 1, and in cases in which display device 1 includes a backlighting or edge-lighting system, to assert an auxiliary video signal to display device 1 for driving device 1's backlighting or edge-lighting elements.

Video preprocessor 7 is coupled and configured to receive a video input signal from source 2, to perform preprocessing thereon, and to assert the preprocessed video signal to video processor 9.

Elements 1, 7, and 9 of the FIG. 1 system can be implemented as subsystems of a single display device, or elements 7 and 9 can be implemented in (or as) a single device distinct from but coupled to display device 1. Typically however, elements 1 and 9 of the FIG. 1 system are implemented as subsystems of a single display device, and preprocessor 7 is implemented a device distinct from this display device, but whose outputs are coupled (e.g., by a cable) to inputs of the display device. Thus, preprocessor 7 can be used in accordance with the invention to calibrate (e.g., recalibrate) a display device comprising elements 1 and 9, or preprocessor 7 can be omitted (e.g., if a user does not desire to calibrate a display device comprising elements 1 and 9 in accordance with the invention).

Device 3 of FIG. 1 includes camera 3A, and processor 4 coupled to receive the output of camera 3A. Typically, device 3 is a camera device as defined above. The camera device is a handheld camera device in preferred embodiments. Alternatively, device 3 is a handheld device that is not a camera device as defined above.

The FIG. 1 system is preferably configured to use device 3 to capture ambient light changes and characteristics of display device 1 (e.g., contrast settings), and to use device 3, remote server 5 (coupled, during operation, to processor 4 of device 3), and preprocessor 7 to perform tone mapping (mapping of displayed color and brightness values characterizing display device 1 to another set of color and brightness values) dynamically in accordance with an embodiment of the invention.

Server 5 is configured to assert display management parameters to video preprocessor 7 in response to data indicative of measurements of color, contrast and brightness of display device 1 made using device 3. Video preprocessor 7 is operable (coupled and configured) to perform calibration (e.g., recalibration) of display device 1 dynamically, by preprocessing an input video signal for device 1 using the display management parameters from server 5. The calibration typically includes tone mapping.

Measurements of color, contrast and brightness of display device 1 can be made using device 3 in accordance with techniques to be described below. These measurements can be filtered and/or otherwise processed using software (e.g., measurement/acquisition application software) running on processor 4 of device 3. In operation, processor 4 is coupled with remote server 5 (e.g., over the internet or another network) and the output of device 3 is forwarded to server 5. In response to the output of device 3 (indicative of a set of values measured by camera 3A of device 3), server 5 generates a new (updated) set of control parameters for video preprocessor 7. Server 5 sends each set of preprocessor control parameters to preprocessor 7 (e.g., over the internet or another network).

Device 3 is typically an inexpensive, handheld camera device whose camera 3A is an inexpensive camera whose sensitivity function is unknown a priori (i.e., before performance of the inventive method) although its sensitivity function may be determined during performance of embodiments of the inventive method in a manner to be described below. Device 3 is operable (in accordance with embodiments of the invention) to measure light emitted by display 1 in a manner emulating at least one measurement (e.g., measurements) by a calibrated reference camera having a known sensitivity function (e.g., an expensive, highly calibrated imaging colorimeter). Processor 4 of device 3 is coupled and configured to receive raw output from camera 3A and to perform at least some processing on the raw output to generate measurement data to be provided to server 5.

Preprocessor 7 can be configured to implement any of a variety of tone mapping algorithms to process the input video data asserted thereto, to accomplish calibration (e.g., recalibration) of display device 1. Each set of preprocessor control parameters generated by server 5 has content and format so as to be useful by preprocessor 7 to implement the appropriate tone mapping algorithm.

For example, preprocessor 7 may implement a conventional tone mapping algorithm of a type known as the Reinhard Tone Mapping Operator ("RTMO"). The RTMO is described in, for example, the paper entitled "Photographic Tone Reproduction for Digital Images," by Erik Reinhard, Mike Stark, Peter Shirley and Jim Ferwerda, ACM Transactions on Graphics, 21(3), July 2002 (Proceedings of SIGGRAPH 2002).

Some conventional tone mapping algorithms (e.g., the above-mentioned RTMO algorithm) map the range of colors and brightness from scene referred content to the dynamic range and color of a display device. They typically generate a set of N tone mapped output luminance values (one for each of N pixels to be displayed) in response to a set of N input luminance values (one for each pixel of an input image), using values indicative of the maximum luminance that can be displayed by the display device and the display contrast (or the maximum and minimum luminances that can be displayed by the display device), the average luminance of the pixels of the input image (sometimes referred to as "scene luminance"), the luminance of an input image pixel that is to be mapped to the middle of the range of luminance values displayable by the display device, and a threshold input image pixel luminance value above which each input pixel is to be mapped to the maximum luminance that can be displayed by the display device.

To generate a set of preprocessor control parameters for use by preprocessor 7 to implement such a conventional tone mapping algorithm to calibrate display 1, server 5 is typically configured to process data from device 3 that are indicative of the following values: ambient brightness (e.g., determined from measurements using camera 3A of the brightness of display 1's surrounding environment, useful to correct measurements by camera 3A of light emitted from display 1 during test image display), the luminance of the brightest white emitted by display 1 while displaying at least one test image, and the contrast of display (which in turn determines the luminance of the darkest black emitted by display 1 while displaying relevant test image(s)).

The preprocessor control parameters generated by server 5 are feedback indicative of measurements by device 3 of light emitted from display 1 (typically during display of at least one test pattern). Elements 3, 5, and 7 of FIG. 1 are thus a feedback subsystem of the FIG. 1 system, coupled and configured to generate preprocessor control parameters automatically in response to measurement data (indicative of measurements by device 3) and to assert preprocessor control parameters from server 5 as calibration feedback to video preprocessor 7. Video preprocessor 7 is operable (coupled and configured) to calibrate (e.g., recalibrate) display 1 in response to the control parameters by filtering input image data (e.g., input video data) to be displayed (e.g., to automatically and dynamically correct for variations in calibration of the display).

In variations on the FIG. 1 embodiment, preprocessor control parameters are generated automatically by a camera or handheld device (e.g., device 3) alone, rather than by a camera or handheld device in combination with a remote display management server (e.g., server 5). In operation of the FIG. 1 system, processor 4 of device 3 is coupled and configured (e.g., programmed with software) to generate measurement data and send the measurement data to remote server 5, and remote server 5 is configured to generate preprocessor control parameters automatically in response to the measurement data. In variations on the FIG. 1 embodiment, a camera device includes a processor coupled and configured (e.g., programmed with software) to generate identical or similar measurement data, to generate preprocessor control parameters in response to the measurement data, and to send (e.g., over the internet or another network) the preprocessor control parameters to a video preprocessor (e.g., preprocessor 7).

To generate a set of preprocessor control parameters for use by preprocessor 7 to implement color calibration of display device 1, server 5 is configured to process data from device 3 that are indicative of light emitted by device 1 in response to a test image (or sequence of test images) indicative of primary colors (e.g., primaries of a standard color space such as Dcinema P3, REC709, or REC601, for example) and at least one white point (e.g., a standard white point such as the well known D65 or D63 white point, for example).

Preferably, preprocessor 7 performs all three of color, contrast, and dynamic range calibration of display device 1, and server 5 generates the required preprocessor control parameters for causing preprocessor 7 to do so. To allow contrast and dynamic range color calibration, test patterns to be described below are preferably asserted to display device 1 for display.

Preferably (e.g., in cases in which display device 1 is configured to implement a dynamic reference mode for luminance), the test patterns displayed by display device 1 during measurements by device 3 (i.e., test patterns for color, contrast, and dynamic range calibration of display device 1) are selected so that the luminance levels of the light emitted by display device 1 in response to the test patterns are low enough to avoid saturating the sensors of device 3's camera 3A at a particular exposure setting.

Figure 7:
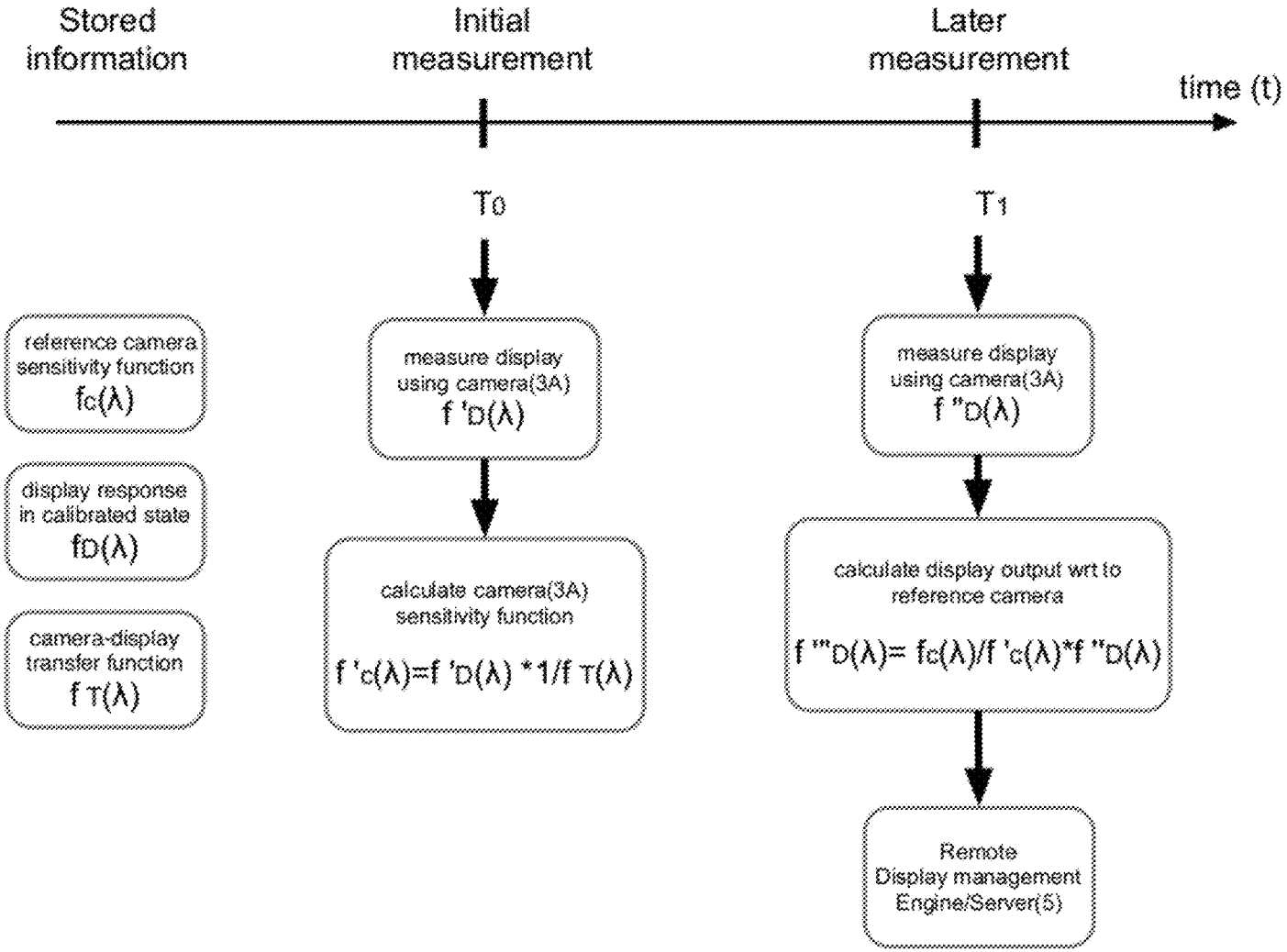
FIG. 7 is a chart of quantities generated or used, and steps performed, in some embodiments of the inventive method.

We next describe color calibration of display device 1 (in accordance with an embodiment of the inventive method) in more detail. FIG. 7 is a chart of quantities generated or used, and steps performed, in this embodiment of the inventive method.

In a preliminary display characterizing operation (preliminary to color calibration of display 1 using device 3, implemented as a camera device, in accordance with the invention), a reference camera (e.g., reference CCD camera) which is precalibrated in the sense that it has a known sensitivity function, $f_c(\lambda)$, where "λ" denote wavelength, is used to measure the output of display 1, $f_D(\lambda)$, as a function of wavelength in response to each test color and white point determined by at least one test pattern. The test pattern(s) are indicative of primary colors (e.g., primaries of a standard color space) and at least one white point (e.g., a standard white point).

This operation determines $f_T(\lambda)=f_D(\lambda)/f_c(\lambda)$, which is the transfer function that matches the display response (for each test color and white point) to the reference camera response. For each test color and white point, a set of values $f_T(\lambda)=f_D(\lambda)/f_c(\lambda)$, and a set of the reference camera sensitivity values $f_c(\lambda)$, for each of a set of wavelengths, λ, are stored for later provision (e.g., downloading over the internet or another network) to device 3. These values are indicated as "stored information" in FIG. 7.

Then (at some "initial" time, denoted as time "T0" in FIG. 7), device 3 (e.g., implemented as a handheld camera device including an inexpensive, uncalibrated camera 3A) is employed to characterize display device 1. Camera 3A of device 3 has a sensitivity function, $f'_c(\lambda)$ that can be (and typically is) unknown a priori (at the start of the preliminary display characterizing operation). At the initial time, camera 3A measures the output, $f'_D(\lambda)$, of display device 1 in response to the same test colors and white point (e.g., in response to the same displayed test pattern(s) employed in the preliminary display characterizing operation) for each of the set of wavelengths, λ. The previously determined values $f_T(\lambda)=f_D(\lambda)/f_c(\lambda)$, and $f_c(\lambda)$, for each of the wavelengths are provided (e.g., downloaded over the internet from the manufacturer of device 1 or 3) to processor 4 of device 3. Programmed processor 4 operates to determine $f'_c(\lambda)=(f'_D(\lambda)/f_D(\lambda))*(f_c(\lambda))=f'_D(\lambda)/(f_D(\lambda)/f_c(\lambda))$, which is the camera sensitivity function of camera 3A, from the measured $f'_D(\lambda)$ values and the provided $f_D(\lambda)/(f_c(\lambda)$ values.

The determined $f'_c(\lambda)$ values (and typically also the $f'_D(\lambda)$ values) are stored in memory (associated with processor 4) in device 3. Then, some later time (denoted as time "T1" in FIG. 7) in order to recalibrate display device 1 (e.g., to match its setting at the initial time), device 3 is again used to measure the output of display device 1, $f''_D(\lambda)$, in response to each test color and white point. Using the measured $f''_D(\lambda)$ values and the stored $f_c(\lambda)$ and $f'_c(\lambda)$ values, device 3 determines $f'''_D(\lambda)=(f_c(\lambda)/f'_c(\lambda))*f''_D(\lambda)$, for each of the wavelengths, which is the display response function (at the time T1) that would have been measured using the calibrated reference camera rather than camera 3A. The $f'''_D(\lambda)$ values are sent to remote server 5, for use in generating preprocessor control parameters for use by preprocessor 7 to recalibrate display 1.

In typical implementations, server 5 of the FIG. 1 system is programmed to use the $f'''_D(\lambda)$ values to generate (and send to preprocessor 7) an updated set of preprocessor control parameters for recalibration of display 1, e.g., to recalibrate display 1 to match a target profile. The target profile can be, but is not necessarily, an initial profile of display 1 (e.g. an initial profile determined at the factory). Alternatively, the target profile is a profile of another display device, in which case the inventive method provides a way to match display 1's profile to that of the other display device. More generally, it should be appreciated that the calibration techniques described herein are useful for performing display matching in a manner different from conventional display matching techniques.

In some embodiments, processor 4 of device 3 determines difference values $d_D(\lambda)=(f_c(\lambda)/f'_c(\lambda))*(f''_D(\lambda)-f'_D(\lambda))$, using the measured $f''_D(\lambda)$ values and the stored $f_c(\lambda)$, $f'_c(\lambda)$, and $f'_D(\lambda)$ values, for each of the wavelengths. The function $d_D(\lambda)$ is the difference between the display response function at the time T1 and the display response function at the initial time, that would have been measured using the calibrated reference camera rather than camera 3A. The difference values $d_D(\lambda)$ values may be sent to remote server 5, for use by server 5 to generate (and send to preprocessor 7) an updated set of preprocessor control parameters for use by preprocessor 7 to recalibrate display 1 to match its settings at the initial time.

Video preprocessor 7 can thus be used to realign the primaries of light emitted by display device 1 to a set of expected primaries, based on misalignment measurements captured by the device 3.

We next describe contrast and dynamic range calibration of display device 1 in more detail.

Figure 4B:
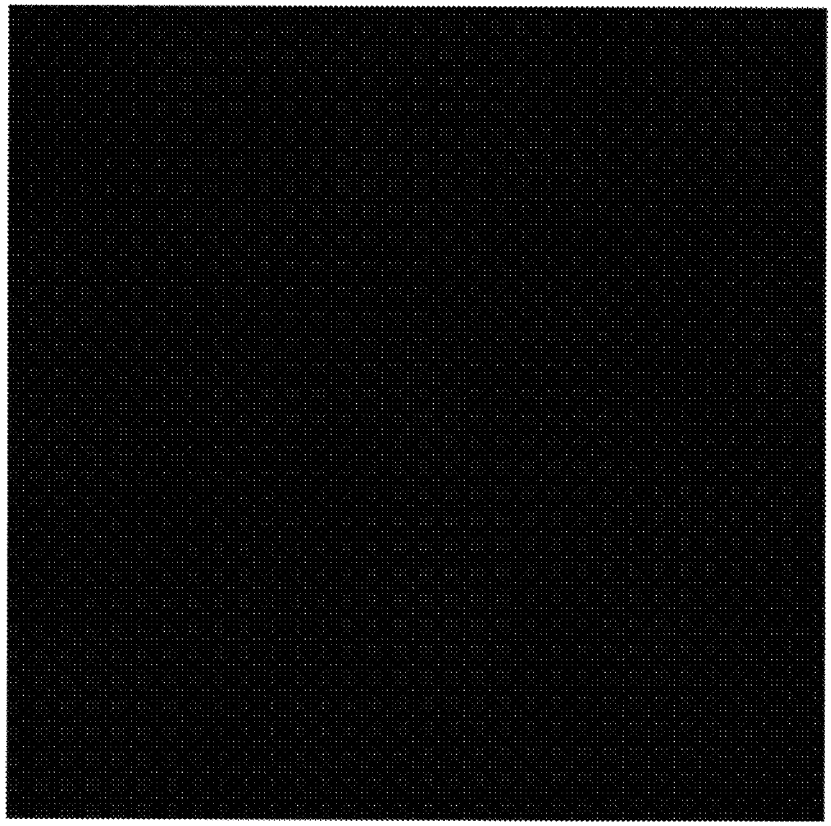
FIG. 4B is a diagram of the Fast Fourier Transform (normalized 2D FFT magnitudes) of the pattern of FIG. 4A.
Figure 4A:
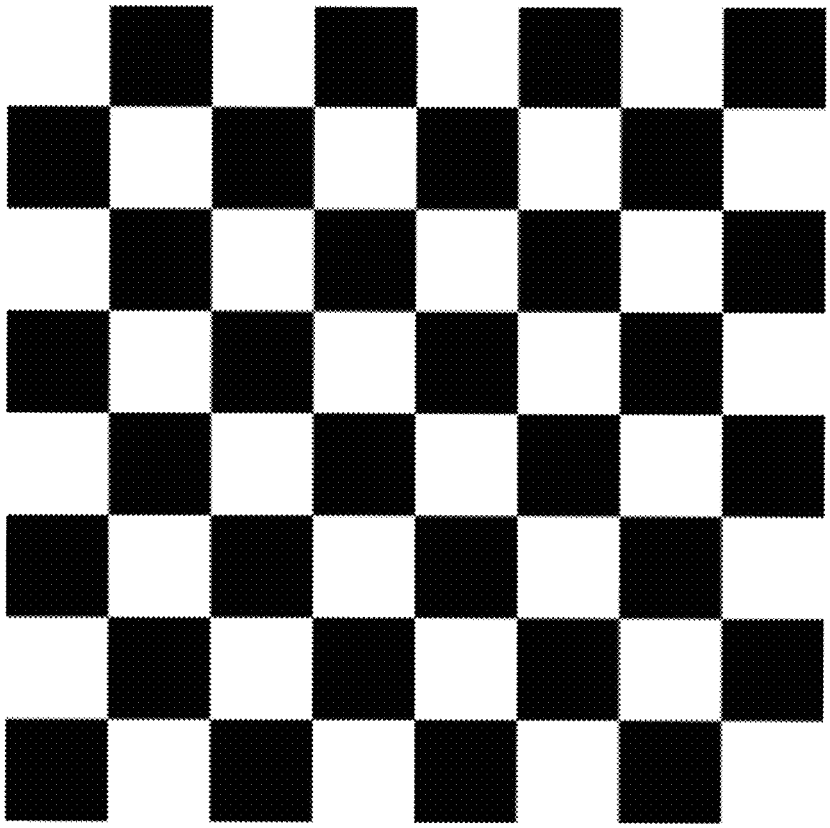
FIG. 4A is a diagram of a uniform checkerboard test pattern.

Contrast ratio can be defined as the ratio of emitted light intensity when displaying a white field to emitted light intensity when displaying a black field. It is often desirable to measure "local" contrast of a display by determining one or more "local" contrast ratios, each of which is a contrast ratio in a different local region (at a specific spatial position) within a displayed image. Contrast ratio determined using a single test pattern having dark (black) and white fields is sometimes referred to as "intra-frame" contrast ratio. Intra-frame contrast ratio is typically measured conventionally using a checkerboard test pattern comprising rectangular white and dark (black) fields in a checkerboard arrangement (e.g., a uniform checkerboard pattern as shown in FIG. 4A).

To perform contrast calibration using the FIG. 1 system in accordance with some embodiments of the inventive method, local contrast of display device 1 is measured as follows using device 3. Device 3 senses the image displayed by display device 1 in response to a checkerboard test pattern that is non-uniform (in the sense that the size of its individual fields varies with spatial position in the displayed image), to determine local (intra-frame) contrast as a function of spatial position in the displayed image. Typically, processor 4 of device 3 executes application software that recognizes location within the displayed image by recognizing a feature size (e.g., the size of the "fields" or "boxes" in a local region of the checkerboard pattern of FIG. 2, 3, 5A, or 6A) associated with each location, and determines contrast at each of one or more locations. The resolution (feature size) at which the fields of uniform checkerboard pattern become flat (the minimum resolvable displayed feature size of the test pattern's features) can readily and efficiently be determined.

In preferred embodiments, camera 3A senses the image displayed by display device 1 in response to a non-uniform test pattern having features of many different sizes (e.g., the pattern of FIG. 2, FIG. 3, FIG. 5A, or FIG. 6A), in which the feature size varies with spatial location (e.g., along linear paths across the pattern) in a well-defined manner. An example of a preferred, non-uniform checkerboard test pattern suitable for this operation is the pattern shown in FIG. 2 (or FIG. 5A). The FIG. 2 pattern has a rectangular outer border, and the size of each field (block) thereof increases with increasing radial distance from the center of the pattern. Another example of a preferred non-uniform checkerboard test pattern suitable for this operation is the dyadic grid pattern shown in FIG. 3. The FIG. 3 pattern also has a rectangular outer border, and the size of each field (block) thereof increases with increasing distance from one outer corner of the pattern. With the non-uniform test pattern of FIG. 2, FIG. 3, FIG. 5A, or FIG. 6A (or a similar non-uniform checkerboard pattern), at the spatial location in the displayed image corresponding to a particular feature size, the checkerboard morphs into a flat color (grey). This indicates the limitation of the intra-frame contrast on the image. Measurement of this value is particularly useful in measuring the intraframe contrast of modulated LED backlit and edgelit display systems where the local contrast is limited by the spacing of the LEDs relative to the LCD pixels.

In alternative embodiments, a sequence of uniform checkerboard test patterns (each of which is uniform across the display screen in the sense that it is a checkerboard pattern with uniform block size) could be displayed to determine local contrast and minimum resolvable displayed test pattern feature size. This would have the advantage of eliminating the need for exact alignment of camera 3A with display 1 (the camera center point could simply be aligned with any point near the center of a test pattern). However, it would not allow efficient determination of both local (intra-frame) contrast and minimum resolvable displayed test pattern feature size.

Figure 2:
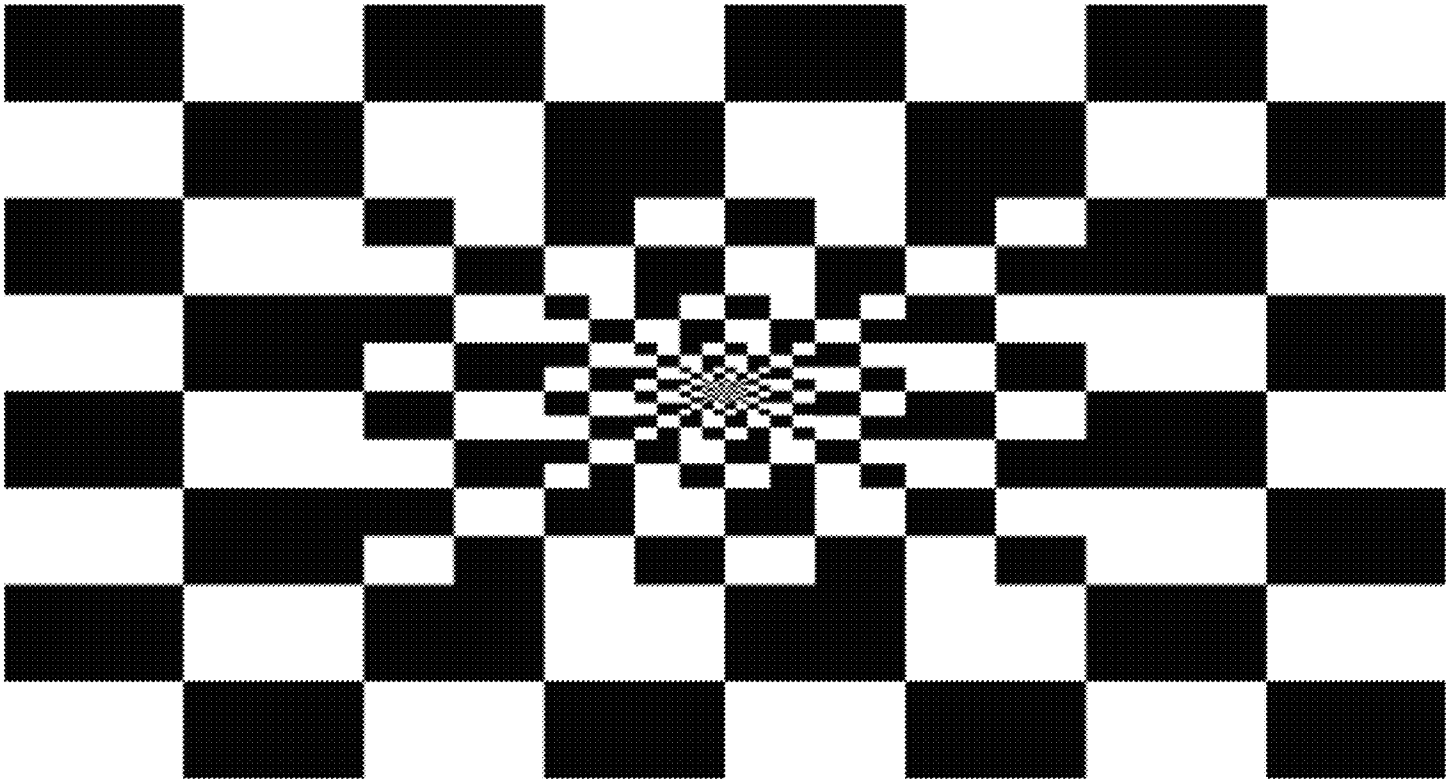
FIG. 2 is a test pattern employed in an embodiment of the inventive method.
Figure 3:
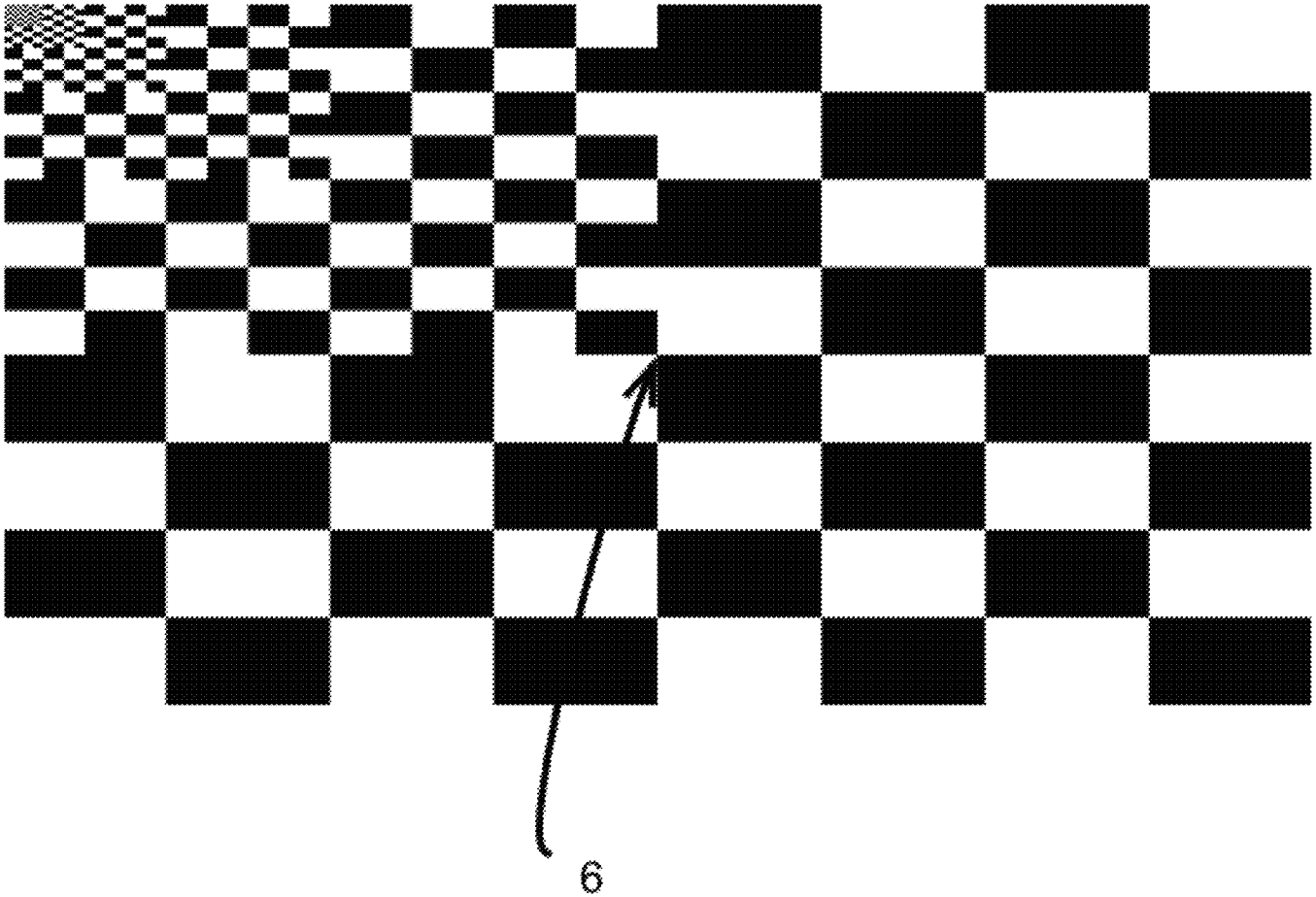
FIG. 3 is a diagram of another test pattern employed in an embodiment of the inventive method.

A non-uniform checkerboard pattern (e.g., as shown in FIG. 2 or 3) can provide an effective measure of local intra-frame contrast. Being two dimensional (in contrast with a pattern consisting of vertical bars), it allows measurement of local contrast variations along both the horizontal and vertical directions in an efficient manner (with reduced time requirement for characterizing such contrast).

Preferably, a single one of the test patterns (e.g., the pattern of FIG. 2 or 3) is displayed by display device 1, and in response device 3 determines a single contrast value (or set of contrast values) and optionally also a value indicative of minimum resolvable displayed feature size. These determined values are then used (e.g., asserted to server 5) with other measured values (determined using other test patterns) to generate an updated set of pre-processor control parameters for preprocessor 7.

The choice as to a preferred test pattern to employ for contrast calibration in a specific implementation of the FIG. 1 system may depend on the ease of alignment of the displayed test pattern with the camera 3A to be employed for the calibration. For example, the FIG. 3 (or FIG. 5A) pattern may be a preferred pattern when camera 3A is a CCD imaging camera, since such a camera may operate in a landscape mode while device 3's processor 4 executes application software to recognize a distinctive pattern in the test pattern (e.g., the distinctive pattern, having features of distinctive size, at center 6 of the FIG. 3 pattern) to facilitate alignment of the center of the displayed test pattern with the center of the camera's CCD array.

It should be appreciated that the uniform checkerboard test pattern of FIG. 4A has a simple Fourier spectrum comprised mainly of odd harmonics of a fundamental, due to its evenly spaced grid-like spatial spectral structure. FIG. 4B is a diagram of the Fast Fourier Transform (normalized 2D FFT magnitudes) of the pattern of FIG. 4A.

Figure 5B:
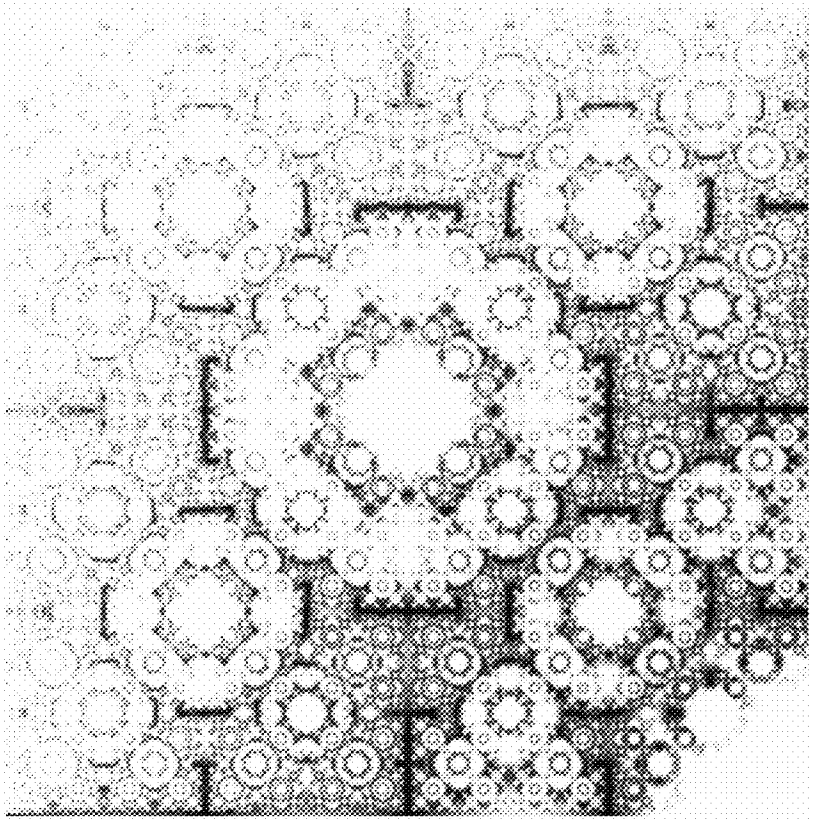
FIG. 5B is a diagram of the Fast Fourier Transform (normalized 2D FFT magnitudes) of the pattern of FIG. 5A.
Figure 5A:
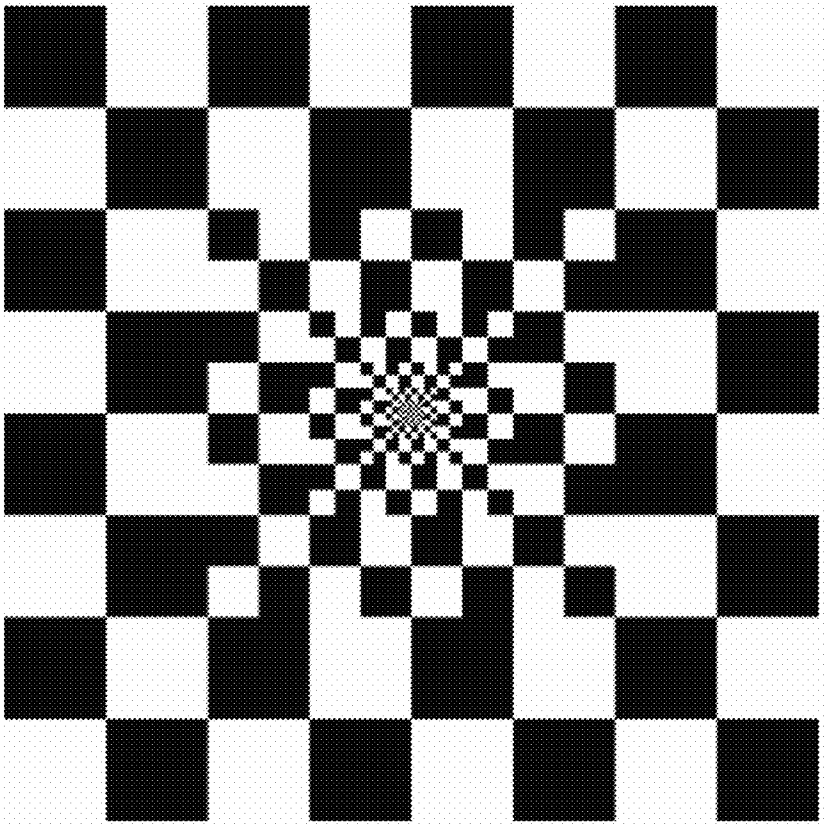
FIG. 5A is a diagram of another test pattern employed in an embodiment of the inventive method.
Figure 6B:
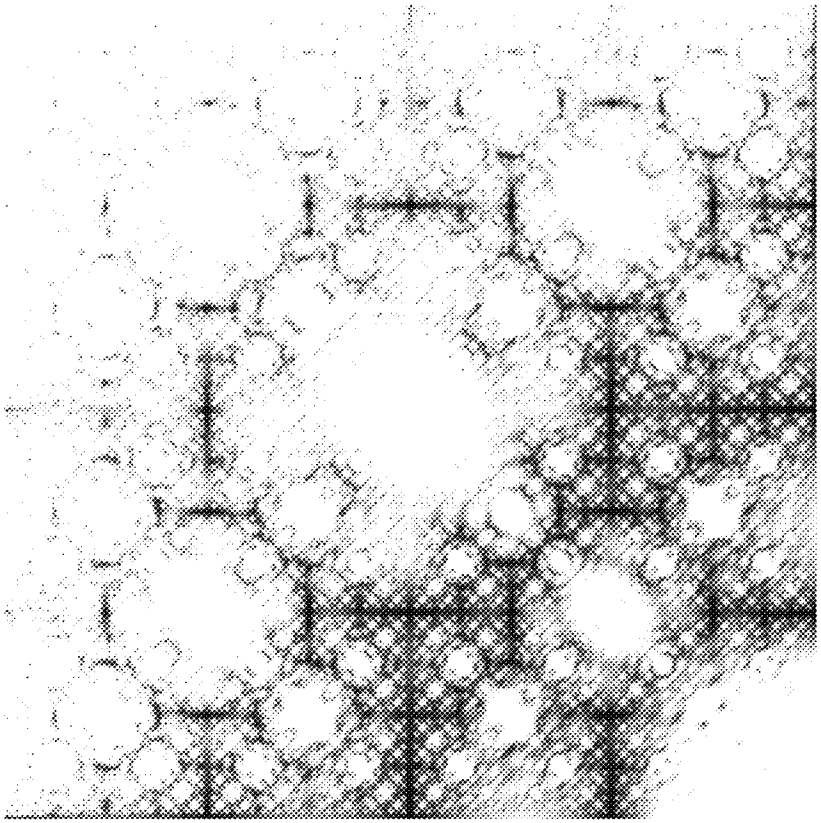
FIG. 6B is a diagram of the Fast Fourier Transform (normalized 2D FFT magnitudes) of the pattern of FIG. 6A.
Figure 6A:
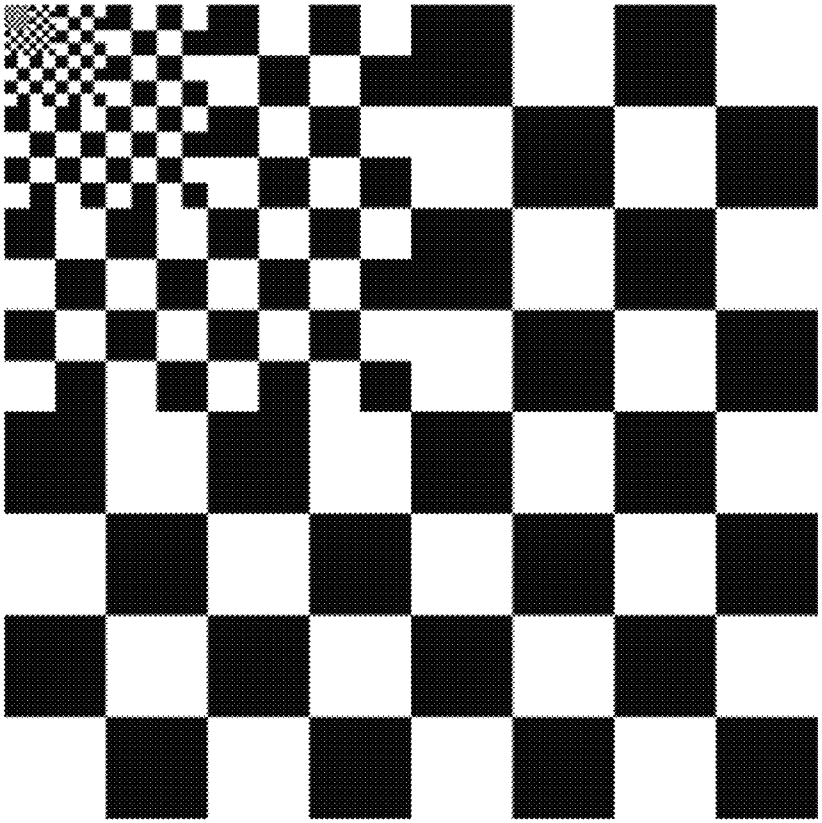
FIG. 6A is a diagram of another test pattern employed in an embodiment of the inventive method.

In contrast, each of FIG. 5A and FIG. 6A is a diagram of a nonuniform checkerboard test pattern employed in an embodiment of the inventive method. FIG. 5B is a diagram of the Fast Fourier Transform (normalized 2D FFT magnitudes) of the pattern of FIG. 5A, and FIG. 6B is a diagram of the Fast Fourier Transform (normalized 2D FFT magnitudes) of the pattern of FIG. 6A. As apparent from FIG. 5B (or 6B), the FIG. 5A (or 6B) pattern has a more complex Fourier spectrum than does the FIG. 4A pattern, due to the varying sizes of its rectangular features. The FIG. 5A (or 6A) pattern is a good example of a structurally simple spatial pattern (useful as a test pattern in some embodiments of the invention) that demonstrates complex spatial transform domain characteristics.

A camera's dynamic range is the ratio of the maximum and minimum light intensities measurable by the camera. A display's dynamic range is the ratio of the maximum and minimum light intensities that can be emitted by the display. To perform brightness or dynamic range calibration of display 1 in accordance with some embodiments of the inventive method, the dynamic range relationship between device 3's camera 3A and display 1 is determined as follows.

The minimum light intensity measurable by a camera (e.g., camera 3A) is typically determined by the camera noise at the exposure values employed. Handheld camera devices typically have a limited number of camera exposure settings. Thus, with device 3 implemented as such a typical handheld device, camera noise can be estimated by operating camera 3A to take a few camera images of a black surface. The maximum light intensity measurable by camera 3A (the high end of the camera's dynamic range) is determined by the measured intensity at which the sensors (e.g., CCDs) in camera 3A start to saturate. To measure the intensity at which the sensors (e.g., CCDs) in camera 3A start to saturate, camera 3A can be operated to image a black and white test pattern displayed by display device 1 (preferably, with display device 1 implemented as a high dynamic range or "HDR" display device) having a range of emitted brightness values at different spatial locations. Preferably, the test pattern is such that the emitted brightness increases with increasing distance from a specific spatial location of the displayed image. For example, the test pattern can be checkerboard pattern or VESA box (comprising a pattern of white and black features) whose ratio of total white feature area to total black feature area in a local region increases (continuously or stepwise) with increasing distance from a specific spatial location on the test pattern. Alternatively, the test pattern can be a grey ramp with coarse levels (for example, 16 vertically arranged grey levels). By displaying such a test pattern with brightness so as not to saturate any sensor in camera 3A that receives light emitted from any spatial location of the displayed image, display 1's dynamic range can be estimated by extrapolating the steps in the camera response given knowledge of the displayed brightness as a function of spatial location of the displayed pattern.

During measurements by device 3, display device 1 can be caused to display test patterns in any of a variety of different ways. For example, device 3 can send them directly to preprocessor 7 or processor 9 as input image data. Or, input video indicative of a sequence of the test patterns can be sent from a source to display device 1 (e.g., from source 2 or server 5 to preprocessor 7 or processor 9 as input image data, and from there to device 1, or from preprocessor 7 or processor 9 to device 1) in response to a command from device 3. The command is optionally relayed from device 3 to the test pattern source through a remote server (e.g., server 5 of FIG. 1, in the case that server 5 is not itself the test pattern source).

In some implementations of the FIG. 1 system, remote server 5 is coupled during performance of the inventive method via the internet (or another network) to device 3. Remote server 5 could be operated by an entity which rents server 5 (to the user of device 3) for executing calibration software to generate preprocessor control parameters in response to the output of device 3 (e.g., remote server 5 could reside on the Amazon Elastic Compute Cloud, sometimes referred to as the "EC2 cloud," or another cloud computing system).

In some embodiments, remote server 5 is configured to be operable in response to output from device 3 to re-render input video (or other input content) that is tone mapped for a specific display device (i.e., device 1) using control parameters determined from the output of device 3, and to feed the re-rendered content to video preprocessor 7 (or directly to processor 9).

In some implementations of the FIG. 1 system, the preprocessor control parameters generated by server 5 are used by preprocessor 7 to correct for display non-uniformities. Such preprocessor control parameters could be generated by server 5 using a display uniformity mask generated by device 3, or could be determined by device 3 using such a display uniformity mask and sent directly from device 3 to video preprocessor 7.

In some embodiments of the invention (e.g., in some implementations of the FIG. 1 system), control parameters for use by a preprocessor to calibrate a display (e.g., control parameters generated by remote server 5) are inserted in blanking intervals of an input video stream. This could be done by the source of the input video (e.g., source 2 of FIG. 1) in response to preprocessor control parameters received from server 5. Preprocessor 7 could be configured to extract the preprocessor control parameters from the blanking intervals and to use the extracted parameters to determine preprocessing to be applied to the input video to implement calibration of display 1.

Figure 3A:
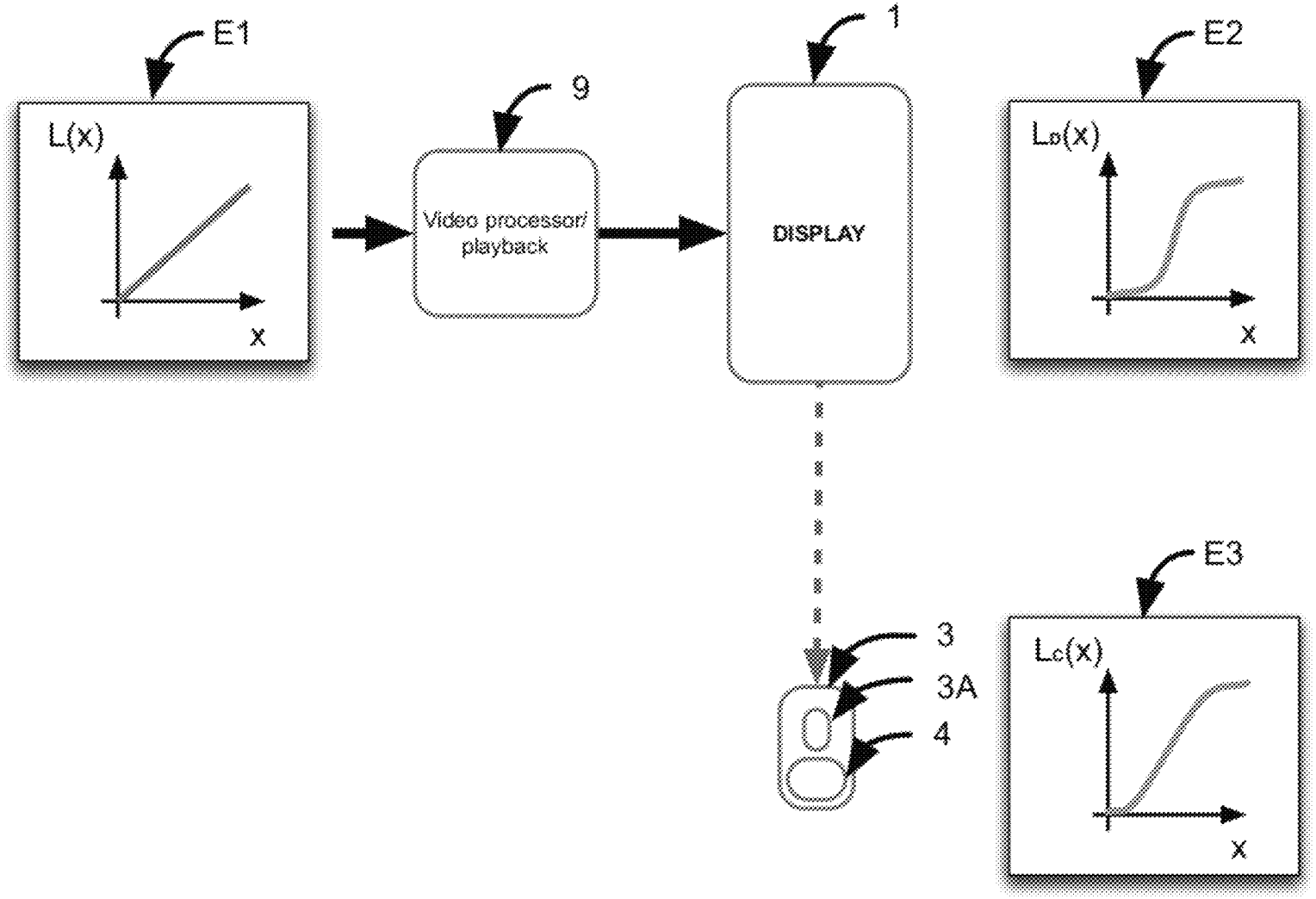
FIG. 3A is a block diagram of an embodiment of the inventive system.

In some embodiments, the inventive system is configured to perform global contrast characterization of a display device. One such system is that of FIG. 3A, in which elements 1, 3, and 9 are identical to elements 1, 3, and 9 of FIG. 1. The FIG. 3A system is configured to make (or allow a user to make) inferences regarding the global dynamic range of display device 1. In the FIG. 3A system, processor 4 of camera device 3 has access to raw CCD pixel values generated by camera 3A. Processor 9 is fed with a ramp input (test image E1) whose luminance increases linearly along the width of the display screen when displayed by device 1. Image E2 is the actual output of display 1 in response to image E1, as measured by a calibrated imaging colorimeter (which is not part of the inventive system) whose dynamic range is wider than that of display device 1. Image E2 is saturated along the top end (at high luminances) and clipped at the bottom end (at low luminances) due to the inherent dynamic range limitations of the display circuitry (input dynamic range) and the display optics (display dynamic range). Image E3 is the output of display device in response to image E1, as measured using camera device 3. Image E3 differs from the response (image E2) of display 1 due to dynamic range mismatch between display 1 and camera 3A. By knowing the dynamic range relationship or transfer function between display 1 and camera 3A at an initial time, processor 4 can estimate the global contrast of display 1 at a later time. This can be fed back to processor 9 (or to a video preprocessor coupled to the input of processor 9) for auto recalibration of display device 1.

Given knowledge of the EOTF (Electro-Optical Transfer Function) of display device 1, the luminance of light emitted by display device 1 in response to a particular input signal codeword can be predicted accurately. Hence, given the response of camera 3A at a particular luminance (lower than the maximum luminance) and the EOTF of display device 1, the response of camera 3A in the camera's saturated range can be estimated very effectively. Such estimates are employed in some embodiments of the inventive method.

For a particular camera device (for example, device 3 implemented as a handheld camera device), it is contemplated that reference data indicative of color matching and/or color response functions (e.g., the above-mentioned reference camera sensitivity function $f_c(\lambda)$, and display response $f_D(\lambda)$) for a particular display can be packaged (e.g., by the manufacturer) into a file readable by the camera device (e.g., a file in a format compatible with the well known "extensible markup language" or XML). In order to recalibrate the color or contrast of a display, a user could load the reference data and appropriate application software into a camera device. While executing the software, the camera device would then make necessary measurements of light emitted by the display, and compare them against corresponding values of the reference data for the measured display, and preferably also determine difference values indicative of the differences between the measured values and corresponding reference data values.

For example, at a time T1, using reference data indicative of a reference camera sensitivity function $f_c(\lambda)$, and display response $f_D(\lambda)$ previously generated using the reference camera, device 3 could determine values $f'_c(\lambda)=f'_D(\lambda)/(f_D(\lambda)/f_c(\lambda))$ indicative of the sensitivity function of the device's camera 3A, and values indicative of display response function $f'''_D(\lambda)=(f_c(\lambda)/f'_c(\lambda))*f''_D(\lambda)$, which is the response function of display 1 at the time T1 that would have been measured using the reference camera used to generate the previously determined display response $f_D(\lambda)$, where $f''_D(\lambda)$ is the response function of display 1 at the time T1 measured using camera 3A of device 3. Processor 4 of device 3 could then compute difference values $\Delta_D(\lambda)=(f'''_D(\lambda)-f_D(\lambda))$, for each of a set of measured wavelengths. The difference values are indicative of changes in characteristics of display 1 since its original calibration using the reference camera, and would then be used to recalibrate the display (e.g., the difference values are sent from device 3 of FIG. 1 to remote server 5, which generates video preprocessor control parameters in response thereto and sends the video preprocessor control parameters to video preprocessor 7 which uses them to recalibrate display 1). More generally, the difference values can be used for one or more of the following operations: auto-recalibration of a display; and feedback preprocessing of input image data (to be displayed by a display) for accurate display management.

Figure 8:
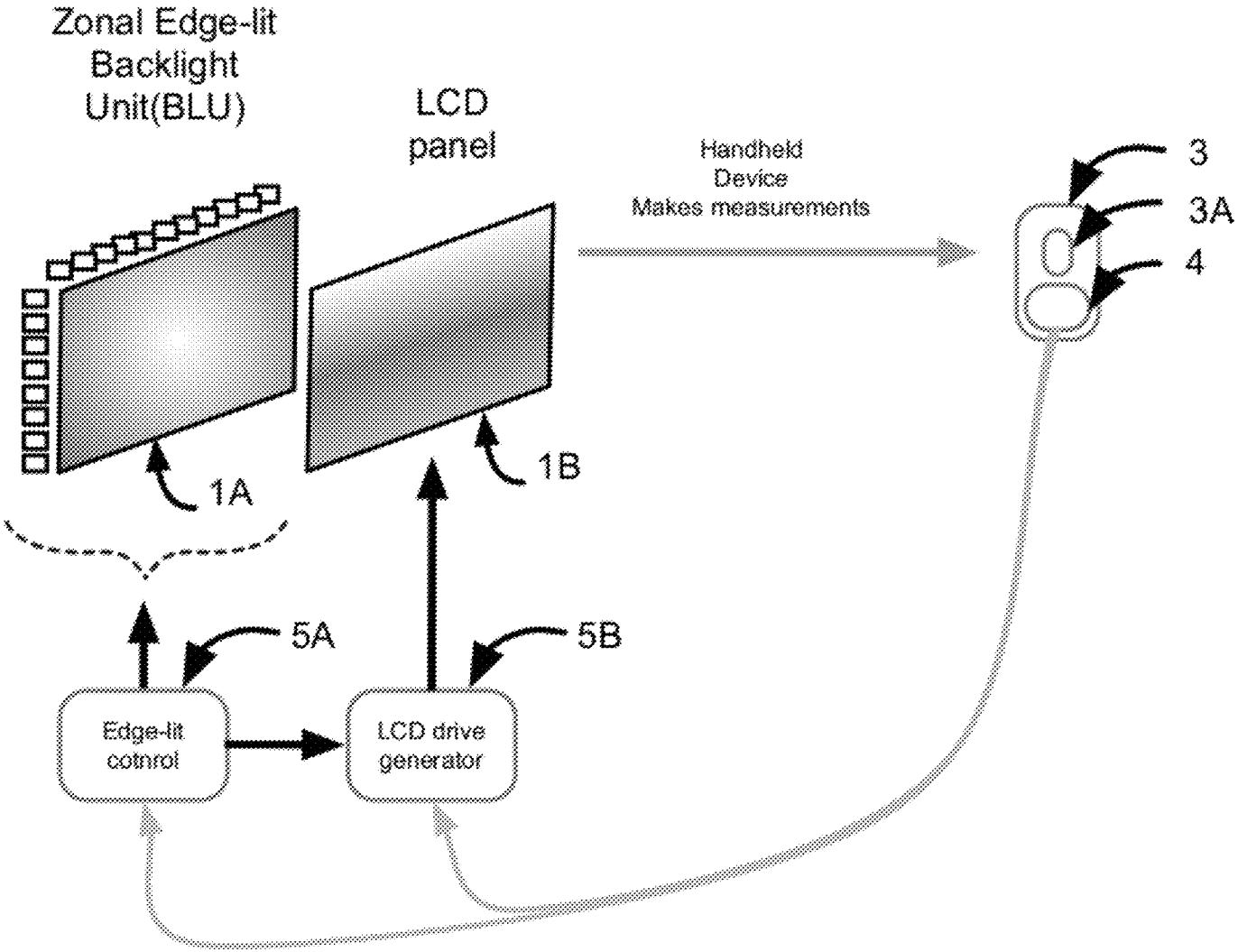
FIG. 8 is a block diagram of another embodiment of the inventive system.

FIG. 8 is a block diagram of an exemplary system which embodies the invention. The display device of FIG. 8 includes front LCD panel 1B, and zonal edge-lit backlight unit 1A ("subsystem" 1A) positioned behind front panel 1B. Subsystem 1A (which may be implemented as described in U.S. patent application Ser. No. 12/882,825, filed on Sep. 15, 2010) includes individually controllable LEDs arranged along edges of a display panel, and a subsystem which directs light from these LEDS to zones of pixels of subsystem 1A's display panel. The full text and disclosure of U.S. patent application Ser. No. 12/882,825 is hereby incorporated herein by reference. Light emitted from subsystem 1A functions to backlight the LCDs of front panel 1B. A processor (not shown) of the display device is coupled and configured to assert a video signal for driving the pixels of panel 1B, and an auxiliary video signal for driving the pixels and edge-lighting elements of subsystem 1A.

In accordance with the invention, camera device 3 of FIG. 8 (which can be identical to camera device 3 of FIG. 1) captures ambient light changes and characteristics of the display device (e.g., contrast settings), and processor 4 of device 3 asserts data indicative of the captured information to a remote server. The remote server comprises LCD drive generator 5B, and edge-lit backlight unit control signal generator 5A. In response to the output of processor 4, generator 5B generates (and asserts to the display device's processor, or to a preprocessor coupled to the inputs of such processor) control parameters for controlling calibration (e.g., recalibration) of panel 1B in accordance with the invention by the display device's processor (or the preprocessor coupled thereto). In response to the output of processor 4, generator 5A generates (and asserts to the display device's processor, or to a preprocessor coupled to the inputs of such processor) control parameters for controlling calibration (e.g., recalibration) of subsystem 1A in accordance with the invention by the display device's processor (or the preprocessor coupled thereto). The calibration control parameters for subsystem 1A can be generated for zones or regions of subsystem 1A's pixels (rather than for individual ones of subsystem 1A's pixels), e.g., by averaging or applying other smoothing functions to calibration control parameters for individual ones of subsystem 1A's pixels and asserting the smoothed or averaged parameters for use in controlling subsystem 1A's edge-lighting elements.

In variations on the FIG. 8 system, the display device is a backlight display with a grid of backlighting LEDs directly behind an LCD front panel (rather than an edge lit backlighting subsystem), and the backlighting LEDs can be controlled (calibrated) in accordance with the invention.

Figure 9:
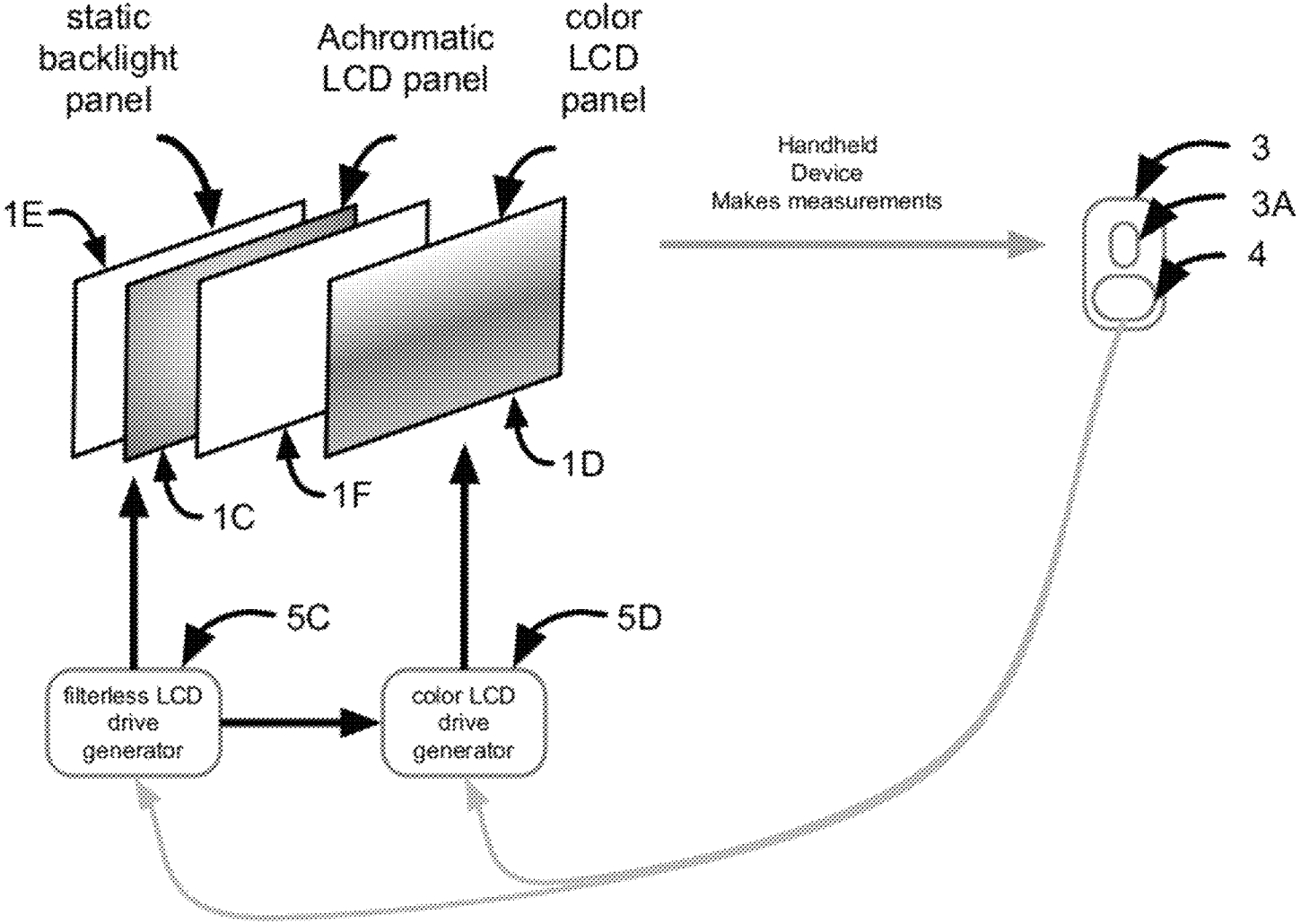
FIG. 9 is a block diagram of another embodiment of the inventive system.

FIG. 9 is a block diagram of another exemplary system which embodies the invention. The display device of FIG. 9 includes front (color) LCD panel 1D, and a backlighting subsystem positioned behind panel 1D. The backlighting subsystem comprises static backlighting panel 1E, achromatic.filterless LCD panel 1C in front of panel 1E, and one or more diffuser films 1F between panels 1C and 1D. The backlighting subsystem and local dimming subsystem may be implemented as described in U.S. patent application Ser. No. 12/780,749, filed on May 14, 2010 (the full text and disclosure of U.S. patent application Ser. No. 12/780,749 is hereby incorporated herein by reference). Light emitted from the backlighting subsystem functions to backlight the LCDs of front panel 1D. A processor (not shown) of the display device is coupled and configured to assert a video signal for driving the pixels of panel 1D, and an auxiliary video signal for driving the pixels of panel 1C.

In accordance with the invention, camera device 3 of FIG. 9 (which can be identical to camera device 3 of FIG. 1) captures ambient light changes and characteristics of the display device (e.g., contrast settings), and processor 4 of device 3 asserts data indicative of the captured information to a remote server. The remote server comprises color LCD drive generator 5D, and filterless LCD drive generator 5C. In response to the output of processor 4, generator 5D generates (and asserts to the display device's processor, or to a preprocessor coupled to the inputs of such processor) control parameters for controlling calibration (e.g., recalibration) of panel 1D in accordance with the invention by the display device's processor (or the preprocessor coupled thereto). In response to the output of processor 4, generator 5C generates (and asserts to the display device's processor, or to a preprocessor coupled to the inputs of such processor) control parameters for controlling calibration (e.g., recalibration) of panel 1C in accordance with the invention by the display device's processor (or the preprocessor coupled thereto). The calibration control parameters for panel 1C can be generated for zones or regions of panel 1C's pixels (rather than for individual ones of panel 1C's pixels), e.g., by averaging or applying other smoothing functions to calibration control parameters for individual ones of panel 1C's pixels.

It should be appreciated that raw data from the camera sensor(s) of the camera device employed in preferred embodiments of the invention (e.g., raw CCD image data from a camera including a CCD sensor array), or a minimally processed version of such raw data, is accessible and actually processed in accordance with such embodiments to achieve accurate implementation of display calibration and/or characterization.

It should also be appreciated that the techniques described herein can be used for accurate representation of nonlinear variations in parameters or characteristics of a display device. For example, determination of a display's response function as a function of frequency over a range of frequencies (e.g., the full range of frequencies in the visible spectrum) can allow nonlinear compensation for nonlinear variations, whereas determining the display's response at each of a small number of frequencies (e.g., one each in the red, green, and blue ranges) would not allow such compensation for nonlinear variations. By making transformations based on the full spectrum of a display, it is possible to achieve more accurate calibration of the display than could be achieved by simple linear operators, e.g., color rotation matrices.

In some embodiments, at least one of the camera or handheld device (e.g., device 3 of FIG. 1), remote server (e.g., server 5 of FIG. 1), and video preprocessor (e.g., preprocessor 7 of FIG. 1) of the inventive system is or includes a field-programmable gate array (FPGA), or other integrated circuit or chip set, programmed and/or otherwise configured to perform steps of an embodiment of the inventive method in response to data asserted thereto). In some embodiments, at least one of the camera or handheld device (e.g., processor 4 of device 3 of FIG. 1), remote server (e.g., server 5 of FIG. 1), and video preprocessor (e.g., preprocessor 7 of FIG. 1) of the inventive system is or includes a programmable digital signal processor (DSP) programmed and/or otherwise configured to perform pipelined processing, including steps of an embodiment of the inventive method, on data. Alternatively, at least one of the camera device (e.g., processor 4 of device 3 of FIG. 1), remote server (e.g., server 5 of FIG. 1), and video preprocessor (e.g., preprocessor 7 of FIG. 1) of the inventive system is or includes a programmable general purpose processor (e.g., a PC or other computer system or microprocessor) coupled to receive or to generate input data, and programmed with software or firmware and/or otherwise configured (e.g., in response to control data) to perform any of a variety of operations on the input data, including steps of an embodiment of the inventive method. For example, at least one of the camera device (e.g., processor 4 of device 3 of FIG. 1), remote server (e.g., server 5 of FIG. 1), and video preprocessor (e.g., preprocessor 7 of FIG. 1) of the inventive system may be or include a computer system (e.g., a PC) including an input device, a memory, and a graphics card that has been appropriately programmed (and/or otherwise configured) to perform steps of an embodiment of the inventive method in response to input data asserted thereto. The graphics card may include a graphics processing unit (GPU), or set of GPUs, dedicated for processing image data and configured to perform the relevant steps of an embodiment of the inventive method. A general purpose processor (or FPGA) configured to perform steps of an embodiment of the inventive method would typically be coupled to an input device (e.g., a mouse and/or a keyboard), a memory, and a display device.

Another aspect of the invention is a computer readable medium (e.g., a disc) which stores code for implementing any embodiment of the inventive method or steps thereof.

While specific embodiments of the present invention and applications of the invention have been described herein, it will be apparent to those of ordinary skill in the art that many variations on the embodiments and applications described herein are possible without departing from the scope of the invention described and claimed herein. It should be understood that while certain forms of the invention have been shown and described, the invention is not to be limited to the specific embodiments described and shown or the specific methods described.

What is claimed is:

1. A method for calibrating a display, using a camera device which includes a camera, said method including steps of:

(a) operating the camera to measure light emitted from the display using the camera, said camera having a sensitivity function that is unknown a priori, and operating the camera device to generate measurement data indicative of the light such that the measurement data are indicative of at least one measurement of said light by a reference camera having known sensitivity function; and (b) using the measurement data as feedback for controlling calibration of the display;

wherein during step (a), the camera measures the light emitted from the display while said display displays at least one test pattern; and wherein the camera device is a handheld camera device, and step (a) includes steps of:

operating the camera device to measure light emitted from the display using the camera while said display displays at least one test image, wherein the at least one test image is indicative of at least one test color and at least one white point; and providing reference data to the camera device for use in generating the measurement data, wherein the reference data are indicative of:

values of a transfer function matching the display's response, to each said test color and each said white point, to the reference camera's response to each said test color and each said white point; and values of the reference camera's sensitivity function.

2. The method of claim 1, wherein the values of the reference camera's sensitivity function are $f_c(\lambda)$, for each wavelength $\lambda$ in a set of wavelengths, the values of the transfer function are $f_T(\lambda)=f_D(\lambda)/f_c(\lambda)$, where values $f_D(\lambda)$ are indicative of output of the display in response to each said test color and each said white point at each said wavelength in the set of wavelengths as measured by the reference camera, and wherein the reference data are also indicative of the values $f_D(\lambda)$, and step (a) includes steps of:

operating the camera device to measure light emitted by the display, thereby determining values of the display's output, $f'_D(\lambda)$, in response to each said test color and each said white point at each said wavelength in the set of wavelengths;

determining values $f'_c(\lambda)=f'_D(\lambda)/(f_D(\lambda)/f_c(\lambda))$, at each said wavelength in the set of wavelengths from the $f'_D(\lambda)$ values and the reference data; and generating the measurement data to be indicative of a difference value $d_D(\lambda)=(f_c(\lambda)/f'_c(\lambda))*(f'_D(\lambda)-f_D(\lambda))$, at each said wavelength in the set of wavelengths.

3. The method of claim 2, wherein step (b) includes the steps of:

generating preprocessor control parameters in response to the measurement data; and operating a video preprocessor to recalibrate the display in response to the preprocessor control parameters.

4. The method of claim 1, wherein the values of the reference camera's sensitivity function are $f_c(\lambda)$, for each wavelength $\lambda$ in a set of wavelengths, the values of the transfer function are $f_T(\lambda)=f_D(\lambda)/f_c(\lambda)$, where values $f_D(\lambda)$ are indicative of output of the display in response to each said test color and each said white point at each said wavelength in the set of wavelengths as measured by the reference camera, and wherein step (a) includes steps of:

at a first time, operating the camera device to measure light emitted by the display, thereby determining values of the display's output, $f'_D(\lambda)$, in response to each said test color and each said white point at each said wavelength in the set of wavelengths;

determining values $f'_c(\lambda)=f'_D(\lambda)/(f_D(\lambda)/f_c(\lambda))$, at each said wavelength in the set of wavelengths from the $f'_D(\lambda)$ values and the reference data;

at a second time, after the first time, again operating the camera device to measure light emitted by the display in response to each said test color and each said white point to determine values of the display's output, $f''_D(\lambda)$, at each said wavelength in the set of wavelengths; and generating the measurement data to be indicative of a value $f''_D(\lambda)=(f_c(\lambda)/f''_c(\lambda))*f''_D(\lambda)$, at each said wavelength in the set of wavelengths.

5. The method of claim 1, wherein the values of the reference camera's sensitivity function are $f_c(\lambda)$, for each wavelength $\lambda$ in a set of wavelengths, the values of the transfer function are $f_T(\lambda)=f_D(\lambda)/f_c(\lambda)$, where values $f_D(\lambda)$ are indicative of output of the display in response to each said test color and each said white point at each said wavelength in the set of wavelengths as measured by the reference camera, and wherein step (a) includes steps of:

at a first time, operating the camera device to measure light emitted by the display, thereby determining values of the display's output, $f'_D(\lambda)$, in response to each said test color and each said white point at each said wavelength in the set of wavelengths;

determining values $f'_c(\lambda)=f'_D(\lambda)/(f_D(\lambda)/f_c(\lambda))$, at each said wavelength in the set of wavelengths from the $f'_D(\lambda)$ values and the reference data;

at a second time, after the first time, again operating the camera device to measure light emitted by the display in response to each said test color and each said white point to determine values of the display's output, $f''_D(\lambda)$, at each said wavelength in the set of wavelengths; and generating the measurement data to be indicative of a difference value $d_D(\lambda)=(f_c(\lambda)/f'_c(\lambda))*(f''_D(\lambda)-f'_D(\lambda))$, at each said wavelength in the set of wavelengths.

6. The method of claim 5, wherein step (b) includes the steps of:

generating preprocessor control parameters in response to the measurement data; and operating a video preprocessor to recalibrate the display in response to the preprocessor control parameters.

7. The method of claim 1, wherein step (b) includes the steps of:

generating preprocessor control parameters in response to the measurement data; and operating a video preprocessor to calibrate the display in response to the preprocessor control parameters.

8. The method of claim 7, wherein the video preprocessor is operated to perform all of color, contrast, and dynamic range calibration of the display in response to the preprocessor control parameters.

9. The method of claim 7, wherein the camera device includes a processor coupled and configured to receive raw output from the camera and to process the raw output to generate the measurement data, and step (b) includes the step of:

sending the measurement data to a remote server, and operating the remote server to generate the preprocessor control parameters in response to the measurement data.

10. The method according to claim 1, wherein the display comprises a 3D capable projector and viewing screen at a venue and the method further comprises the step of applying a filter to the light to be measured, wherein the filter corresponds to a 3D technology utilized by the 3D capable projector light to be measured.

11. The method according to claim 1, wherein the display comprises 3D imaging via dual projectors each comprising a fixed spectral separation filter, and wherein the display is installed at a venue comprising multiple screens.

12. The method according to claim 1, wherein the display comprises a quantum dot display.

13. The method according to claim 1, wherein the display comprises an LCD display.

14. The method according to claim 1, wherein the camera device comprises a smartphone and the camera is operated according to an app installed on the smartphone.

15. A display calibration system, including:

a camera device including a camera operable to measure light emitted from a display, said camera having a sensitivity function that is unknown a priori, the camera device also including a processor coupled and configured to receive raw output from the camera and to process the raw output to generate measurement data indicative of the light, such that the measurement data are indicative of at least one measurement of said light by a reference camera having known sensitivity function; and a calibration subsystem coupled and configured to generate control parameters in response to the measurement data, and to calibrate the display in response to the control parameters;

wherein the control parameters are preprocessor control parameters, and the calibration subsystem includes:

a remote server coupled and configured to generate the preprocessor control parameters in response to the measurement data; and a video preprocessor coupled and configured to calibrate the display by performing preprocessing on image data to be displayed, in response to the preprocessor control parameters.

16. The system of claim 15, wherein the camera device is a handheld camera device.

17. A display calibration system, including:

a display;

a camera device including a camera operable to measure light emitted from the display, said camera having a sensitivity function that is unknown a priori, the camera device also including a processor coupled and configured to receive raw output from the camera and to process the raw output to generate measurement data indicative of the light, such that the measurement data are indicative of at least one measurement of said light by a reference camera having known sensitivity function; and a calibration subsystem coupled and configured to generate control parameters in response to the measurement data, and to calibrate the display in response to the control parameters;

wherein the camera device is a handheld camera device, the raw output from the camera is indicative of at least one measurement of light emitted from the display while said display displays at least one test image indicative of at least one test color and at least one white point, and the processor is configured to generate the measurement data in response to reference data and the raw output from the camera, wherein the reference data are indicative of:

a transfer function matching the display's response, to each said test color and each said white point, to the reference camera's response to each said test color and each said white point; and values of the reference camera's sensitivity function.

18. A display calibration system, including:

a display;

a camera device including a camera operable to measure light emitted from the display, said camera having a sensitivity function that is unknown a priori, the camera device also including a processor coupled and configured to receive raw output from the camera and to process the raw output to generate measurement data indicative of the light, such that the measurement data are indicative of at least one measurement of said light by a reference camera having known sensitivity function; and a calibration subsystem coupled and configured to generate control parameters in response to the measurement data, and to calibrate the display in response to the control parameters;

wherein the control parameters are preprocessor control parameters, and the calibration subsystem includes:

a remote server coupled and configured to generate the preprocessor control parameters in response to the measurement data; and a video preprocessor coupled and configured to calibrate the display by performing preprocessing on image data to be displayed, in response to the preprocessor control parameters.

19. The system of claim 18, wherein the video preprocessor is operable to perform all of color, contrast, and dynamic range calibration of the display in response to the preprocessor control parameters.

20. The system according to claim 18, wherein the system is installed at a venue, the display comprises a 3D projector and a cinema screen, and the system further comprises a set of filters corresponding to channel filtering for left and right viewing channels of 3D images projected by the projector and wherein the measured light comprises light from images projected on the screen filtered according to one of the filters.

21. The system according to claim 18, wherein the system is installed at a venue, the display comprises a 3D laser projector and a cinema screen, and the system further comprises a set of either spectral separation or polarization based filters corresponding to channel filtering for left and right viewing channels of 3D images projected by the projector and wherein the measured light comprises light from images projected on the screen filtered according to one of the filters.

22. A system, including:

a display;

a video preprocessor coupled to the display; and a feedback subsystem including a handheld device operable to measure light emitted by the display, wherein the feedback subsystem is coupled and configured to generate preprocessor control parameters automatically in response to measurement data indicative of measurements by the handheld device and to assert the preprocessor control parameters as calibration feedback to the video preprocessor;

wherein the handheld device includes:

a camera operable to measure the light emitted from the display, said camera having a sensitivity function that is unknown a priori; and a processor coupled and configured to receive raw output from the camera and to process the raw output to generate the measurement data, such that said measurement data are indicative of at least one measurement of said light by a reference camera having known sensitivity function; and wherein the raw output from the camera is indicative of at least one measurement of light emitted from the display while said display displays at least one test image indicative of at least one test color and at least one white point, and the processor is configured to generate the measurement data in response to reference data and the raw output from the camera, wherein the reference data are indicative of:

a transfer function matching the display's response, to each said test color and each said white point, to the reference camera's response to each said test color and each said white point; and values of the reference camera's sensitivity function.

23. The system of claim 22, wherein the video preprocessor is coupled to receive the preprocessor control parameters and operable to calibrate the display in response to said preprocessor control parameters by filtering input image data to be displayed by the display.

24. The system of claim 22, wherein the handheld device is a handheld camera device, and the video preprocessor is coupled to receive the preprocessor control parameters and operable to calibrate the display in response to said preprocessor control parameters by filtering input image data to be displayed by the display.

25. The system of claim 22, wherein the feedback subsystem also includes:

a remote server coupled and configured to generate the preprocessor control parameters in response to the measurement data, and to assert said preprocessor control parameters to the video preprocessor.

26. The system of claim 22, wherein the video preprocessor is operable to perform all of color, contrast, and dynamic range calibration of the display in response to the preprocessor control parameters.

27. The system according to claim 22, wherein the system is installed at a multiplex theater venue.

28. The system according to claim 22, wherein the display comprises a laser projector and a screen at a venue.

29. The system according to claim 28, wherein the system further comprises a remote server configured to receive data from the venue and control the laser projector.

30. The system according to claim 22, wherein the laser projector comprises a 3D projector and the system further comprises at least one filter configured filter light from at least one channel of a 3D image projected by the 3D laser projector and wherein the filtered light is measured by the handheld device.

31. The method according to claim 22, wherein the handheld device comprises a smartphone, such as an i-phone, and the camera is operated according to an app installed on the smartphone.

32. A method for calibrating a display, including the steps of:

(a) operating a handheld device to measure light emitted by the display and to generate measurement data indicative of measurements by the handheld device;

(b) generating preprocessor control parameters in response to the measurement data; and (c) asserting the preprocessor control parameters to a video preprocessor, and operating the video preprocessor to calibrate the display in response to said preprocessor control parameters by filtering input image data to be displayed by the display;

wherein the handheld device is a handheld camera device including a camera and a processor, the camera is operable to measure the light emitted from the display and has a sensitivity function that is unknown a priori, the processor is coupled to receive raw camera output from the camera, said raw camera output is indicative of at least one measurement by the camera of the light emitted from the display, and step (a) includes the step of:

operating the processor to generate the measurement data in response to the raw camera output, such that said measurement data are indicative of at least one measurement of said light by a reference camera having known sensitivity function;

wherein the raw camera output is indicative of at least one measurement of light emitted from the display while said display displays at least one test image indicative of at least one test color and at least one white point, and wherein step (a) includes a step of:

operating the processor to generate the measurement data in response to reference data and the raw camera output, wherein the reference data are indicative of:

values of a transfer function matching the display's response, to each said test color and each said white point, to the reference camera's response to each said test color and each said white point; and values of the reference camera's sensitivity function.

33. The method of claim 32, also including the step of:

asserting the measurement data to a remote server, and operating the remote server to generate the preprocessor control parameters in response to the measurement data.

34. The method of claim 32, wherein the values of the reference camera's sensitivity function are $f_c(\lambda)$, for each wavelength $\lambda$ in a set of wavelengths, the values of the transfer function are $f_T(\lambda)=f_D(\lambda)/f_c(\lambda)$, where values $f_D(\lambda)$ are indicative of output of the display in response to each said test color and each said white point at each said wavelength in the set of wavelengths as measured by the reference camera, and wherein the reference data are also indicative of the values $f_D(\lambda)$, and step (a) includes steps of:

operating the camera device to measure light emitted by the display, thereby determining values of the display's output, $f'_D(\lambda)$, in response to each said test color and each said white point at each said wavelength in the set of wavelengths;

determining values $f'_c(\lambda)=f'_D(\lambda)/(f_D(\lambda)/f_c(\lambda))$, at each said wavelength in the set of wavelengths from the $f'_D(\lambda)$ values and the reference data; and generating the measurement data to be indicative of a difference value $d_D(\lambda)=(f_c(\lambda)/f'_c(\lambda))*(f'_D(\lambda)-f_D(\lambda))$, at each said wavelength in the set of wavelengths.

35. The method of claim 34, wherein step (c) includes the step of operating the video preprocessor to recalibrate the display in response to the preprocessor control parameters.

36. The method of claim 32, wherein step (c) includes a step of operating the video preprocessor to perform color calibration of the display in response to the preprocessor control parameters.

37. The method of claim 32, wherein the values of the reference camera's sensitivity function are $f_c(\lambda)$, for each wavelength $\lambda$ in a set of wavelengths, the values of the transfer function are $f_T(\lambda)=f_D(\lambda)/f_c(\lambda)$, where values $f_D(\lambda)$ are indicative of output of the display in response to each said test color and each said white point at each said wavelength in the set of wavelengths as measured by the reference camera, and wherein step (a) includes steps of:

at a first time, operating the camera device to measure light emitted by the display, thereby determining values of the display's output, $f'_D(\lambda)$, in response to each said test color and each said white point at each said wavelength in the set of wavelengths;

determining values $f'_c(\lambda)=f'_D(\lambda)/(f_D(\lambda)/f_c(\lambda))$, at each said wavelength in the set of wavelengths from the $f'_D(\lambda)$ values and the reference data;

at a second time, after the first time, again operating the camera device to measure light emitted by the display in response to each said test color and each said white point to determine values of the display's output, $f''_D(\lambda)$, at each said wavelength in the set of wavelengths; and generating the measurement data to be indicative of a value $f'''_D(\lambda)=(f_c(\lambda)/f'_c(\lambda))*f''_D(\lambda)$, at each said wavelength in the set of wavelengths.

38. The method of claim 32, wherein the values of the reference camera's sensitivity function are $f_c(\lambda)$, for each wavelength $\lambda$ in a set of wavelengths, the values of the transfer function are $f_T(\lambda)=f_D(\lambda)/f_c(\lambda)$, where values $f_D(\lambda)$ are indicative of output of the display in response to each said test color and each said white point at each said wavelength in the set of wavelengths as measured by the reference camera, and wherein step (a) includes steps of:

at a first time, operating the camera device to measure light emitted by the display, thereby determining values of the display's output, $f'_D(\lambda)$, in response to each said test color and each said white point at each said wavelength in the set of wavelengths;

determining values $f'_c(\lambda)=f'_D(\lambda)/(f_D(\lambda)/f_c(\lambda))$, at each said wavelength in the set of wavelengths from the $f'_D(\lambda)$ values and the reference data;

at a second time, after the first time, again operating the camera device to measure light emitted by the display in response to each said test color and each said white point to determine values of the display's output, $f''_D(\lambda)$, at each said wavelength in the set of wavelengths; and generating the measurement data to be indicative of a difference value $d_D(\lambda)=(f_c(\lambda)/f'_c(\lambda))*(f''_D(\lambda)-f'_D(\lambda))$, at each said wavelength in the set of wavelengths.

39. The method of claim 38, wherein step (c) includes a step of operating the video preprocessor to recalibrate the display in response to the preprocessor control parameters generated in response to the measurement data.

40. The method of claim 32, wherein step (c) includes the step of operating the video preprocessor to perform all of color, contrast, and dynamic range calibration of the display in response to the preprocessor control parameters.

41. The method of claim 32, wherein step (a) includes a step of operating the handheld device to measure ambient light in the display's environment, and the measurement data are generated in response to at least one measurement by the camera of said ambient light.

42. A method for calibrating a display, including the steps of:

(a) operating a handheld device to measure light emitted by the display and to generate measurement data indicative of measurements by the handheld device;

(b) generating preprocessor control parameters in response to the measurement data; and (c) asserting the preprocessor control parameters to a video preprocessor, and operating the video preprocessor to calibrate the display in response to said preprocessor control parameters by filtering input image data to be displayed by the display;

wherein the handheld device includes a camera and a processor, the camera is operable to measure the light emitted from the display, and the processor is coupled to receive raw camera output from the camera, and said raw camera output is indicative of at least one measurement by the camera of the light emitted from the display, wherein step (c) includes a step of operating the video preprocessor to perform contrast calibration of the display in response to the preprocessor control parameters, and wherein the raw camera output is indicative of at least one measurement of light emitted from the display while said display displays a checkerboard test pattern that is non-uniform in the sense that sizes of individual fields thereof vary with spatial position, and wherein the measurement data are indicative of local intra-frame contrast.

43. The method of claim 42, wherein step (c) includes a step of operating the video preprocessor to perform dynamic range calibration of the display in response to the preprocessor control parameters, and wherein the measurement data are indicative of light, emitted from the display while said display displays a test pattern, having a range of emitted brightness values at different spatial locations.

44. The method of claim 43, wherein the brightness values increase with increasing distance from a specific spatial location of the test pattern.

45. The method according to claim 42, wherein the display comprises a 3D capable projector and viewing screen at a venue and the method further comprises the step of applying a filter to the light to be measured, wherein the filter corresponds to a 3D technology utilized by the 3D capable projector light to be measured, wherein the 3D technology and the filter comprises technology based on one of spectral separation, and polarization wherein each filter comprises left and right channel filters utilized to capture left and right image data for analysis by the method.

46. The method according to claim 42, wherein the display comprises a laser projector and viewing screen at a venue; the method further comprising the step of sending data to a remote server and controlling the projector via the remote server.

47. A method for calibrating a display, including the steps of:

(a) operating a handheld device to measure light emitted by the display and to generate measurement data indicative of measurements by the handheld device;

(b) generating preprocessor control parameters in response to the measurement data; and (c) asserting the preprocessor control parameters to a video preprocessor, and operating the video preprocessor to calibrate the display in response to said preprocessor control parameters by filtering input image data to be displayed by the display;

wherein the handheld device includes a camera and a processor, the camera is operable to measure the light emitted from the display, and the processor is coupled to receive raw camera output from the camera, and said raw camera output is indicative of at least one measurement by the camera of the light emitted from the display, wherein the raw camera output is indicative of light emitted from the display while said display displays a checkerboard test pattern that is non-uniform in the sense that sizes of individual fields thereof vary with spatial position, and wherein the measurement data are indicative of local intra-frame contrast.

48. The method according to claim 47, wherein the display comprises a 3D capable projector and viewing screen at a venue comprising multiple screens and the method further comprises the step of applying a filter to the light to be measured, wherein the filter corresponds to a 3D technology utilized by the 3D capable projector light to be measured.

49. The method according to claim 48, wherein the venue comprises multiple screens, the 3D technology and the filter comprises technology based on one of spectral separation, polarization, and shutters, and the handheld device comprises a smartphone, such as an i-phone, and the camera is operated according to an app installed on the smartphone.

50. The method according to claim 48, further comprising a step of sending data to a remote server for analysis, directing operation of the projector from the remote server.

51. A handheld camera device, including:

a camera, operable to measure light emitted from a display, said camera having a sensitivity function that is unknown a priori; and a processor, coupled and configured to receive raw output from the camera indicative of at least one measurement of light emitted from the display, and to process the raw output to generate measurement data indicative of the light, such that the measurement data are indicative of at least one measurement of said light by a reference camera having known sensitivity function;

wherein the processor is configured to receive raw output from the camera indicative of at least one measurement of light emitted from the display while said display displays at least one test image indicative of at least one test color and at least one white point, and the processor is configured to process the raw output and reference data to generate the measurement data, where the reference data are indicative of:

values of a transfer function matching the display's response, to each said test color and each said white point, to the reference camera's response to each said test color and each said white point; and values of the reference camera's sensitivity function.

52. The handheld camera device of claim 51, wherein the processor is configured to send the measurement data to a remote server, for processing to generated control parameters for controlling calibration of the display.

53. The handheld camera device of claim 51, wherein the values of the reference camera's sensitivity function are $f_c(\lambda)$, for each wavelength $\lambda$ in a set of wavelengths, the values of the transfer function are $f_T(\lambda)=f_D(\lambda)/f_c(\lambda)$, where values $f_D(\lambda)$ are indicative of output of the display in response to each said test color and each said white point at each said wavelength in the set of wavelengths as measured by the reference camera, and wherein the reference data are also indicative of the values $f_D(\lambda)$, and the processor is configured to:

determine values of the display's output, $f'_D(\lambda)$, in response to each said test color and each said white point at each said wavelength in the set of wavelengths from output of the camera indicative of measurement of light emitted by the display at a first time in response to said at least one test image;

determine values $f'_c(\lambda)=f'_D(\lambda)/(f_D(\lambda)/f_c(\lambda))$, at each said wavelength in the set of wavelengths from the $f'_D(\lambda)$ values and the reference data; and generate the measurement data to be indicative of a difference value $d_D(\lambda)=(f_c(\lambda)/f'_c(\lambda))*(f'_D(\lambda)-f_D(\lambda))$, at each said wavelength in the set of wavelengths.

54. The handheld camera device of claim 51, wherein the values of the reference camera's sensitivity function are $f_c(\lambda)$, for each wavelength $\lambda$ in a set of wavelengths, the values of the transfer function are $f_T(\lambda)=f_D(\lambda)/f_c(\lambda)$, where values $f_D(\lambda)$ are indicative of output of the display in response to each said test color and each said white point at each said wavelength in the set of wavelengths as measured by the reference camera, and the processor is configured to:

determine values of the display's output, $f'_D(\lambda)$, in response to each said test color and each said white point at each said wavelength in the set of wavelengths, from output of the camera indicative of measurement of light emitted by the display at a first time in response to said at least one test image;

determine $f'_c(\lambda)=f'_D(\lambda)/(f_D(\lambda)/f_c(\lambda))$, at each said wavelength in the set of wavelengths from the $f'_D(\lambda)$ values and the reference data, and identifying $f'_c(\lambda)$ as the sensitivity function of said camera;

determine values of the display's output, $f''_D(\lambda)$, in response to each said test color and each said white point at each said wavelength in the set of wavelengths, from output of the camera indicative of measurement of light emitted by the display at a second time, after the first time, in response to said at least one test image; and generate the measurement data to be indicative of a value $f'''_D(\lambda)=(f_c(\lambda)/f'_c(\lambda))*f''_D(\lambda)$, at each said wavelength in the set of wavelengths.

55. The handheld camera device of claim 51, wherein the values of the reference camera's sensitivity function are $f_c(\lambda)$, for each wavelength $\lambda$ in a set of wavelengths, the values of the transfer function are $f_T(\lambda)=f_D(\lambda)/f_c(\lambda)$, where values $f_D(\lambda)$ are indicative of output of the display in response to each said test color and each said white point at each said wavelength in the set of wavelengths as measured by the reference camera, and the processor is configured to:

determine values of the display's output, $f'_D(\lambda)$, in response to each said test color and each said white point at each said wavelength in the set of wavelengths, from output of the camera indicative of measurement of light emitted by the display at a first time in response to said at least one test image;

determine values $f'_c(\lambda)=f'_D(\lambda)/(f_D(\lambda)/f_c(\lambda))$, at each said wavelength in the set of wavelengths from the $f'_D(\lambda)$ values and the reference data;

determine values of the display's output, $f''_D(\lambda)$, in response to each said test color and each said white point at each said wavelength in the set of wavelengths, from output of the camera indicative of measurement of light emitted by the display at a second time, after the first time, in response to said at least one test image; and generate the measurement data to be indicative of a difference value $d_D(\lambda)=(f_c(\lambda)/f'_c(\lambda))*(f''_D(\lambda)-f'_D(\lambda))$, at each said wavelength in the set of wavelengths.

56. The handheld camera device of claim 51, wherein the processor is configured to receive raw output from the camera indicative of at least one measurement of light emitted from the display while said display displays a checkerboard test pattern that is non-uniform in the sense that sizes of individual fields thereof vary with spatial position, and wherein the measurement data are indicative of local intra-frame contrast.

* * * * *